US005657926A

United States Patent [19]

Toda

[11] Patent Number: 5,657,926

[45] Date of Patent: Aug. 19, 1997

[54] ULTRASONIC ATOMIZING DEVICE

[76] Inventor: Kohji Toda, 1-49-18 Futaba, Yokosuka 239, Japan

[21] Appl. No.: 421,512

[22] Filed: Apr. 13, 1995

[51] Int. Cl.[6] ..... B05B 1/08

[52] U.S. Cl. ..... 239/102.2; 239/102.1; 239/338

[58] Field of Search ..... 239/102.1, 102.2, 239/338

[56] References Cited

U.S. PATENT DOCUMENTS 5,297,734 3/1994 Toda ..... 239/102.2

FOREIGN PATENT DOCUMENTS 5-261324 12/1993 Japan ..... 239/102.2

*Primary Examiner*—Robert J. Oberleitner
*Assistant Examiner*—Pamela J. Lipka

[57] ABSTRACT

An ultrasonic atomizing device comprising a piezoelectric vibrator, at least an interdigital transducer P comprising two parts $P_D$ and $P_F$, at least an electrode G, electrode terminals $T_D$, $T_F$ and $T_G$ formed on the parts $P_D$, $P_F$ and electrode G, respectively, a vibrating plate connected to the piezoelectric vibrator, a self-oscillator circuit, and means for dispensing a liquid to the vibrating plate. The interdigital transducer P and the electrode G are formed on two end surfaces of the piezoelectric vibrator, respectively. When an electric signal with a frequency substantially equal to one of the resonance frequencies of the piezoelectric vibrator is applied to the piezoelectric vibrator through the electrode terminals $T_D$ and $T_G$, the piezoelectric vibrator is vibrated acoustically. The acoustic vibration is not only transmitted to the vibrating plate, but also transduced to an electric signal between the electrode terminals $T_F$ and $T_G$. The acoustic vibration transmitted to the vibrating plate is consumed for liquid atomization effectively. The voltage between the electrode terminals $T_F$ and $T_G$, that arises from the piezoelectricity of the piezoelectric vibrator is fedback, and again, applied to the electrode terminals $T_D$ and $T_G$, which is essential for supplying the mechanical vibration energy for liquid atomization. The self-oscillator circuit is confirmed to work for continuous, stable liquid atomization without special compensation, for considerably large resonance frequency deviation of the piezoelectric vibrator.

4 Claims, 19 Drawing Sheets

ULTRASONIC ATOMIZING DEVICE

BACKGROUND OF THE INVENTION

1. Field of the Invention

The present invention relates to an ultrasonic atomizing device which is vibrating device for atomizing a liquid by the acoustic vibration generated with a vibrating assembly.

2. Description of the Prior Art

Conventional ultrasonic atomizing devices include, (1) a nebulizer-type atomizer using a thickness mode of a disk-shaped ceramic vibrator, (2) an atomizer using a bolt-clamped Langevin-type vibrator with a through hole, and (3) a circular plate piston vibrator with a vibrating plate. The first one is in practical use. It is difficult to miniaturize and to improve the power consumption efficiency of these techniques.

An ultrasonic vibrating device presented by Toda in U.S. Pat. No. 5,297,734, realized high atomization efficiency and high ability for atomizing minute and uniform particles. Moreover, the prior Toda device has a small size which is very light and has a simple structure. However, the prior Toda device needs a high operation voltage and a circuit having a large size which is heavy and has a complicated structure. In addition, the prior Toda device is affected by the resonance frequency variation associated with temperature change, causing continuous-unstable liquid atomization and high voltage operation with high power consumption.

This application is an improvement of the application for the prior Toda device.

SUMMARY OF THE INVENTION

An object of the present invention is to provide an ultrasonic atomizing device capable of continuous-stable liquid atomization under the resonance frequency variation associated with temperature change.

Another object of the present invention is to provide an ultrasonic atomizing device capable of continuous-stable atomizing of minute and uniform particles under low voltage operation with low power consumption.

A still other object of the present invention is to provide an ultrasonic atomizing device capable of continuous-stable providing of a large quantity of fog particles.

A still further object of the present invention is to provide an ultrasonic atomizing device having a small-sized circuit with a simple structure.

According to one aspect of the present invention there is provided an ultrasonic atomizing device comprising:

- a piezoelectric vibrator having two end surfaces running perpendicular to the thickness direction of the piezoelectric vibrator;
- at least an interdigital transducer P formed on one end surface of the piezoelectric vibrator, the interdigital transducer P comprising two parts $P_D$ and $P_F$, the part $P_D$ having about two times as large area on the one end surface of the piezoelectric vibrator as the part $P_F$;
- at least an electrode G, formed on the other end surface of the piezoelectric vibrator;
- electrode terminals $T_D$ and $T_F$ formed on the parts $P_D$ and $P_F$, respectively;
- electrode terminal $T_G$ formed on the electrode G;
- a vibrating plate having a plurality of holes and connected to the electrode G;

- a self-oscillator circuit; and
- means for dispensing a liquid to the plurality of holes.

The piezoelectric vibrator, the vibrating plate, the interdigital transducer P and the electrode G form a vibrating assembly. The electrode terminals $T_D$ and $T_G$ receive an electric signal with a frequency approximately equal to a resonance frequency of the vibrating assembly and cause the piezoelectric vibrator to vibrate acoustically. The piezoelectric vibrator causes the vibrating plate to vibrate acoustically and generates an electric signal between the electrode terminals $T_F$ and $T_G$. The electrode terminals $T_F$ and $T_G$ delivers the electric signal, generated between the electrode terminals $T_F$ and $T_G$ and having a frequency approximately equal to the resonance frequency of the vibrating assembly. The vibrating plate atomizes a liquid dispensed to the plurality of holes by the acoustic vibration of the vibrating plate. Each of the plurality of holes has an inlet opening portion and an outlet opening portion. The liquid penetrates from the inlet opening portion to the outlet opening portion during atomizing the liquid, the circumference of the inlet opening portion being larger than that of the outlet opening portion.

According to another aspect of the present invention there is provided a self-oscillator circuit comprising:

- a direct current power supply $V_{dc}$;
- a coil $L_1$ connected between the direct current power supply $V_{dc}$ and the electrode terminal $T_D$; and
- a transistor $T_{r1}$, output terminal thereof being connected to the electrode terminal $T_D$ and input terminal thereof being connected to the electrode terminal $T_F$. In the self-oscillator circuit, the vibrating assembly acts as a resonance element and the transistor $T_{r1}$ acts as a feedback amplifier element.

According to another aspect of the present invention there is provided a self-oscillator circuit comprising:

- a direct current power supply $V_{dc}$;
- a current pick up circuit comprising a first diode $D_1$ connected in series to the electrode terminals $T_F$ and $T_G$, and a second diode $D_2$ connected in parallel to the first diode $D_1$ with the opposite polarity to the first diode $D_1$, the current pick up circuit picking up a phase of a current between the electrode terminals $T_F$ and $T_G$;
- a voltage amplifying circuit including an inverter $IC_1$ and amplifying a weak voltage picked up by the current pick up circuit; and
- a power amplification circuit including a transistor $T_{r1}$ and a coil $L_1$ for raising a voltage in a passage for applying the transistor $T_{r1}$ with a direct current, an output power of the power amplification circuit being applied through the electrode terminals $T_D$ and $T_G$. In the self-oscillator circuit, the vibrating assembly acts as a resonance element and the transistor $T_{r1}$ acts as a feedback amplifier element.

According to another aspect of the present invention there is provided a piezoelectric vibrator having a rectangular plate-shaped body, the ratio of length to width thereof being substantially equal to 1, an area between the parts $P_D$ and $P_F$ on the one end surface of the piezoelectric vibrator being located parallel to the length direction of the piezoelectric vibrator, and the vibrating plate being mounted on an edge of the electrode G in parallel to the width direction of the piezoelectric vibrator.

According to another aspect of the present invention there is provided a piezoelectric vibrator having a rectangular pillar-shaped body, the ratio of length to width, length to thickness, or width to thickness thereof being substantially equal to 1, an area between the parts $P_D$ and $P_F$ on the one end surface of the piezoelectric vibrator being located parallel to the length direction of the piezoelectric vibrator, and the vibrating plate being mounted on an edge of the electrode G in parallel to the width direction of the piezoelectric vibrator.

According to another aspect of the present invention there is provided an ultrasonic atomizing device comprising:

a piezoelectric vibrator having two end surfaces running perpendicular to the thickness direction of the piezoelectric vibrator;

at least two electrodes D and F, formed on one end surface of the piezoelectric vibrator with electrically separated condition each other;

at least an electrode G formed on the other end surface of the piezoelectric vibrator;

electrode terminals $T_D$, $T_F$ and $T_G$, formed on the electrodes D, F and G, respectively;

a vibrating plate having a plurality of holes and connected to the electrode G;

a self-oscillator circuit; and means for dispensing a liquid to the plurality of holes.

The piezoelectric vibrator, the vibrating plate, the electrodes D, F and G form a vibrating assembly.

According to another aspect of the present invention there is provided a piezoelectric vibrator having a rectangular plate-shaped body, the ratio of length to width thereof being substantially equal to 1, the electrode D having about three to four times as large area on the end surface of the piezoelectric vibrator as the electrode F, a linear area between the electrodes D and F on the end surface of the piezoelectric vibrator being located parallel to the length direction of the piezoelectric vibrator, and the vibrating plate being mounted on an edge of the electrode G in parallel to the width direction of the piezoelectric vibrator.

According to a further aspect of the present invention there is provided a piezoelectric vibrator having a pillar-shaped body with a pierced hole located parallel to the thickness direction of the piezoelectric vibrator, the ratio of length in the thickness direction of the piezoelectric vibrator to the shortest distance between the outer edge and the inner edge of an end surface of the piezoelectric vibrator being approximately equal to 1, the electrode D having approximately the same area on the end surface of the piezoelectric vibrator as the electrode F, or the area not only more than the same as the electrode F but also less than five times the electrode F, and the vibrating plate covering an opening of the pierced hole.

BRIEF DESCRIPTION OF THE DRAWINGS

Other features and advantages of the invention will be clarified from the following description with reference to the attached drawings.

DETAILED DESCRIPTION OF THE PRESENTLY PREFERRED EXEMPLARY EMBODIMENTS

Figure 1:
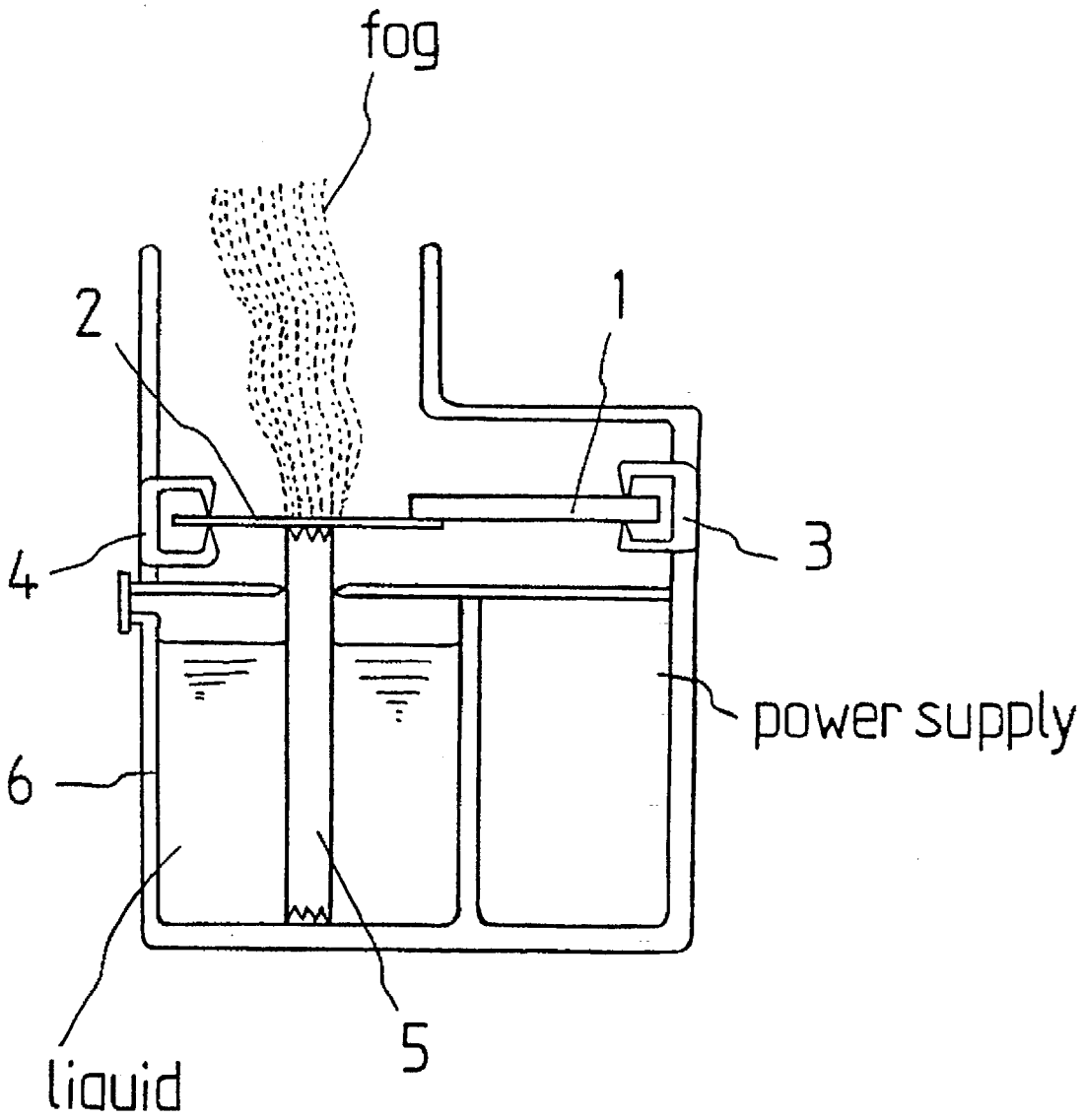
FIG. 1 shows a sectional view of the ultrasonic atomizing device according to an embodiment of the present invention.

FIG. 1 shows a sectional view of an ultrasonic atomizing device according to an embodiment of the present invention. The ultrasonic atomizing device comprises a piezoelectric vibrator 1, a vibrating plate 2, a supporting material 3, a supporting material 4, a liquid-keeping material 5, a liquid bath 6, a self-oscillator circuit 7, an interdigital transducer P formed on one end surface of the piezoelectric vibrator 1 and comprising two parts $P_D$ and $P_F$, an electrode G formed on the other end surface of the piezoelectric vibrator 1, and electrode terminals $T_D$, $T_F$ and $T_G$, made from copper ribbon. The self-oscillator circuit 7, the interdigital transducer P comprising the parts $P_D$ and $P_F$, the electrode G, electrode terminals $T_D$, $T_F$ and $T_G$ are not drawn in FIG. 1.

The interdigital transducer P and the electrode G are made from aluminium thin film, respectively. The electrode terminals $T_D$, $T_F$ and $T_G$ are cemented on the parts $P_D$, $P_F$ and electrode G, respectively, by an adhesive agent which is of high conductivity. The piezoelectric vibrator 1, the vibrating plate 2, the interdigital transducer P and the electrode G form a vibrating assembly. The supporting material 3 has a part contacting with the piezoelectric vibrator 1 and being made of materials providing an acoustic impedance that is very low compared with that of the piezoelectric vibrator 1. The supporting material 4 has a part contacting with the vibrating plate 2 and being made of materials providing an acoustic impedance that is very low compared with that of the vibrating plate 2. The liquid-keeping material 5 made of materials having large liquid suction capacity and low acoustic impedance lifts a liquid from the liquid bath 6 and supplies the liquid to the lower surface of the vibrating plate 2. The liquid bath 6 is supplied with an adequate amount of liquid in operation.

Figure 2:
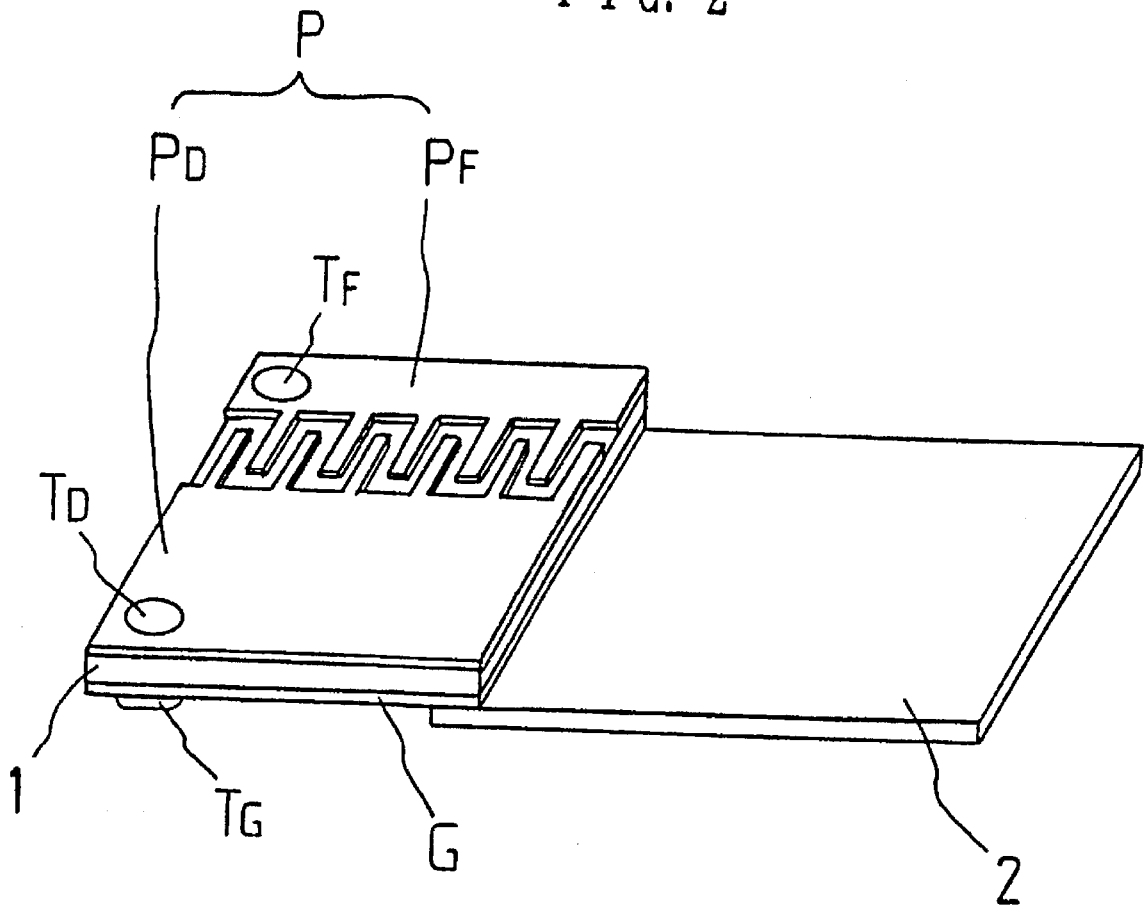
FIG. 2 shows a perspective view of the vibrating assembly with the electrode terminals $T_D$, $T_F$ and $T_G$, shown in FIG. 1.

FIG. 2 shows a perspective view-of the vibrating assembly with the electrode terminals $T_D$, $T_F$ and $T_G$. The piezoelectric vibrator 1 has a rectangular plate-shaped body made of a TDK-72A piezoelectric ceramic (TDK Company) providing a high electromechanical coupling constant, and having dimensions of 17 mm in length, 20 mm in width and 1 mm in thickness. The piezoelectric vibrator 1 has two end surfaces running perpendicular to the thickness direction thereof. The direction of the polarization axis of the piezoelectric vibrator 1 is parallel to the thickness direction thereof. Each electrode terminal $T_D$, $T_F$ or $T_G$, is mounted at one edge along the width direction of the piezoelectric vibrator 1. The vibrating plate 2 made of stainless steel has a first surface portion and a second surface portion on the upper surface thereof, the first surface portion being cemented to the piezoelectric vibrator 1 with an electroconductive epoxy resin (Dotite, Fujikura Chemical) in contact with the electrode G, the second surface portion being not cemented to the piezoelectric vibrator 1. The dimensions of the vibrating plate 2 are 20 mm in length, 20 mm in width and 0.05 mm in thickness. The dimensions of the first surface portion of the vibrating plate 2 are 2 mm in length and 20 mm in width. Thus, the dimensions of the second surface portion of the vibrating plate 2 are 18 mm in length and 20 mm in width.

Figure 3:
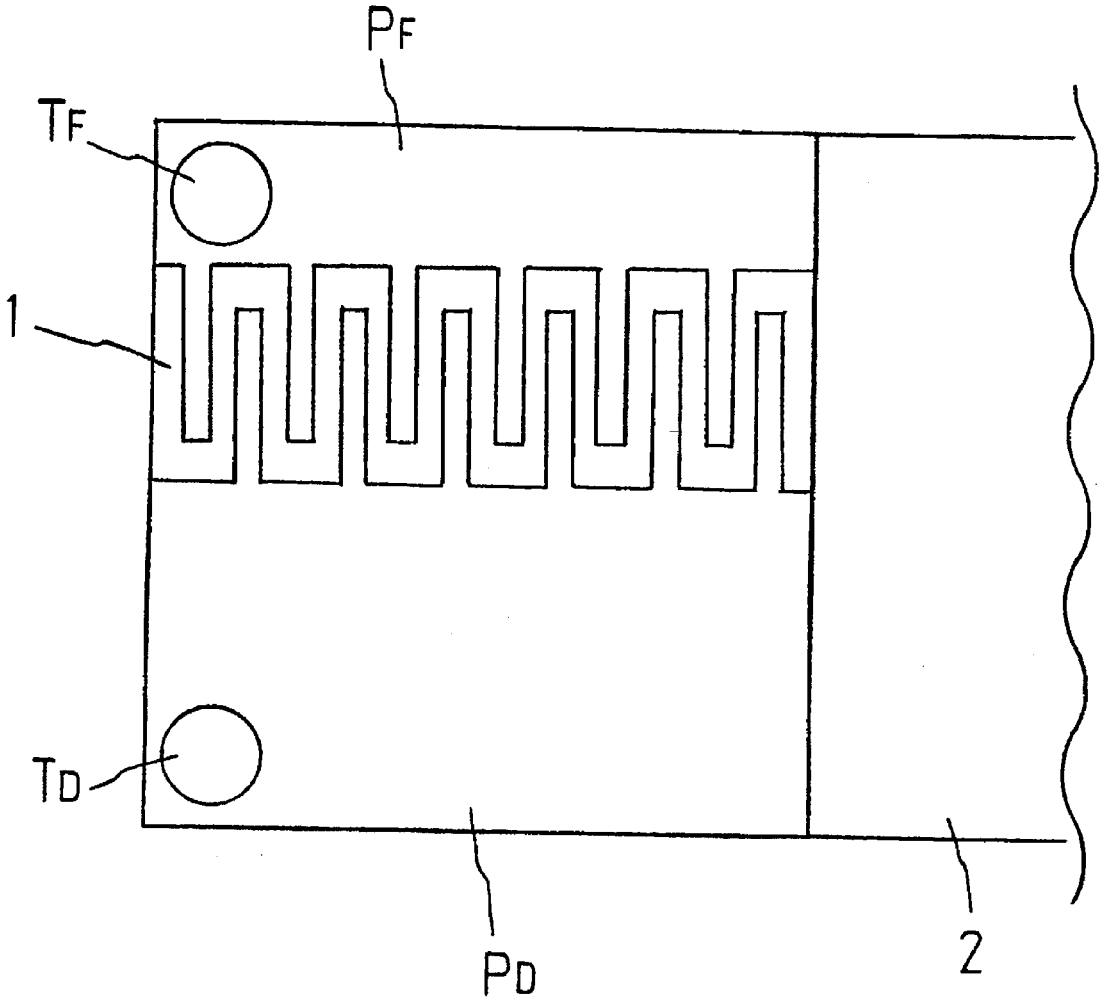
FIG. 3 shows an upper plan view of the vibrating assembly with the electrode terminals $T_D$, $T_F$ and $T_G$, shown in FIG. 1.

FIG. 3 shows an upper plan view of the vibrating assembly with the electrode terminals $T_D$, $T_F$ and $T_G$, shown in FIG. 2. The interdigital transducer P consisting of six finger pairs has an interdigital periodicity of 2 mm and an overlap length of 4.8 mm. The part $P_D$ has about two times as large area on the one end surface of the piezoelectric vibrator 1 as the part $P_F$.

Figure 4:
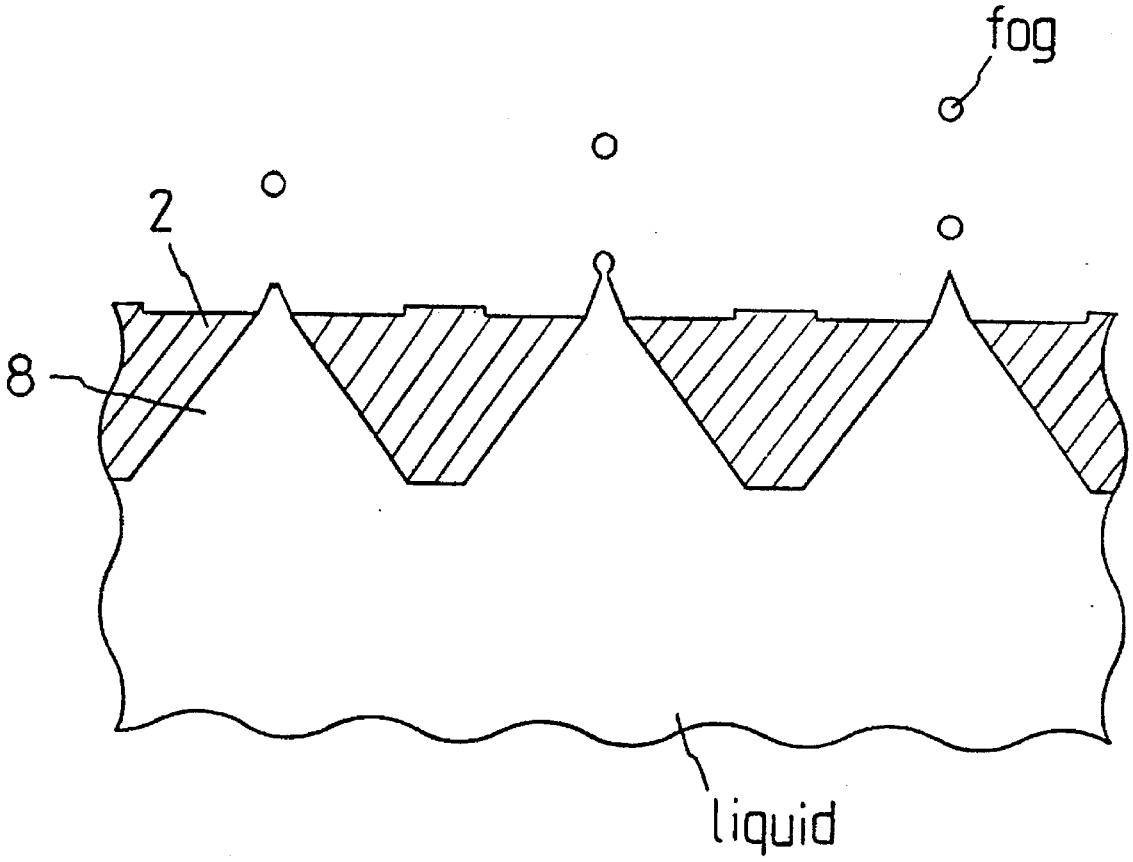
FIG. 4 shows a fragmentary vertical sectional view of the vibrating plate 2 shown in FIG. 1.

FIG. 4 shows a fragmentary vertical sectional view of the vibrating plate 2 shown in FIG. 1. The vibrating plate 2 is provided with plurality of minute holes 8 with high density. Each of the holes 8 has a conical shape. The separation length between two neighboring holes 8 is 90 μm. The diameters of each of the holes 8 are about 7 and 80 μm on the upper and lower surfaces of the vibrating plate 2, respectively.

Figure 5:
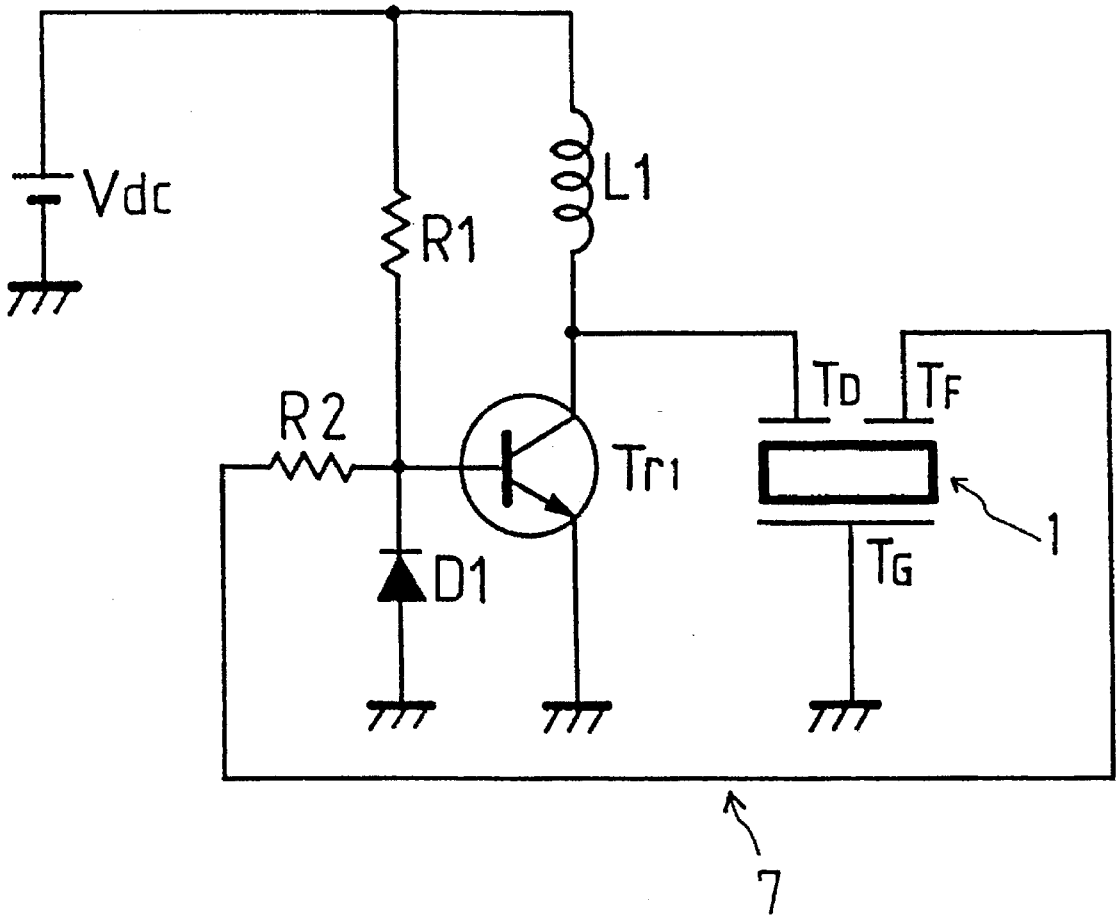
FIG. 5 shows a diagram of the self-oscillator circuit 7.

FIG. 5 shows a diagram of the self-oscillator circuit 7. The self-oscillator circuit 7 contains a coil $L_1$ connected between a direct current power supply $V_{dc}$ and the electrode terminal $T_D$, and a transistor $T_{r1}$, an output terminal thereof being connected to the electrode terminal $T_D$ and an input terminal thereof being connected to the electrode terminal $T_F$. When an electric signal with a frequency substantially equal to one of the resonance frequencies of the piezoelectric vibrator 1 is applied to the piezoelectric vibrator 1 through the electrode terminals $T_D$ and $T_G$, the piezoelectric vibrator 1 is vibrated acoustically. The acoustic vibration is not only transmitted from the piezoelectric vibrator 1 to the vibrating plate 2 through the first surface portion of the vibrating plate 2, but also transduced, between the electrode terminals $T_F$ and $T_G$, to an electric signal, with a frequency approximately equal to a resonance frequency of the vibrating assembly. In this time, the transmittance of the acoustic vibration from the piezoelectric vibrator 1 to the supporting material 3 is suppressed, because the acoustic impedance thereof is very low compared with that of the piezoelectric vibrator 1. In the same way, the transmittance of the acoustic vibration from the vibrating plate 2 to the supporting material 4 is suppressed, because the acoustic impedance thereof is very low compared with that of the vibrating plate 2. Thus, the acoustic vibration transmitted to the vibrating plate 2 is consumed for liquid atomization effectively. A liquid lifted by the liquid-keeping material 5 from the liquid bath 6 to the lower surface of the vibrating plate 2 is led to inlet opening portion of each of the holes 8 by capillarity, and atomized in the vertical direction under a strong acoustic vibrating condition of the vibrating plate 2. In this time, the liquid squeezes out by each of the holes 8. The transmittance of the acoustic vibration from the vibrating plate 2 to the liquid-keeping material 5 is suppressed, because the acoustic impedance thereof is very low compared with that of the vibrating plate 2, and the liquid-keeping material 5 has only a small touching area with the vibrating plate 2. The holes 8 operate as excellent nozzles, providing a liquid having minute and uniform fog particles. On the other hand, the voltage between the electrode terminals $T_F$ and $T_G$, that arises from the piezoelectricity of the piezoelectric vibrator 1 as a resonance element, is fedback via the transistor $T_{r1}$ operating as a feedback amplifier element. The electric signals at the electrode terminals $T_D$ and $T_F$ are 180° out of phase. The voltage across the coil $L_1$ is applied to the electrode terminals $T_D$ and $T_G$, which is essential for supplying the mechanical vibration energy for liquid atomization. In this way, a positive feedback loop with the best self-oscillation is constructed. The oscillation frequency of the self-oscillator circuit 7 is almost equal to the resonance frequency of the vibrating assembly, and is varied in response to the variation of the resonance frequency of the vibrating assembly. The best oscillation condition is maintained in the self-oscillator circuit 7, causing a continuous-stable liquid atomization. The self oscillator circuit 7 is confirmed to work for continuous, stable liquid atomization without special compensation, for considerably large resonance frequency deviation of the piezoelectric vibrator 1 in the temperature range below 80° C. In addition, the self-oscillator circuit 7 is composed of only a few parts, that is, the coil $L_1$, the transistor $T_{r1}$, two resistors $R_1$ and $R_2$, and a diode $D_1$, making the device size small and compact. Though the self-oscillator circuit 7 has only a few parts, it is possible to use the direct current power supply $V_{dc}$, causing a high power consumption efficiency. Thus, it is possible to miniaturize the power supply. Therefore, the ultrasonic atomizing device has a small size with a simple structure.

The vibrating assembly shown in FIG. 2 has the piezoelectric vibrator 1 with a rectangular plate-shaped body, the ratio of length to width thereof being substantially equal to 1. Therefore, a coupled-mode vibration of the vibrating assembly is strengthened. In addition, the first surface portion of the vibrating plate 2 is cemented and integrally interlocked with one end surface of the piezoelectric vibrator 1. Accordingly, the acoustic vibration can be transmitted to all the vibrating plate 2 over effectively through the first surface portion acting as a cemented end.

When operating the ultrasonic atomizing device shown in FIG. 1, the best self-oscillation is realized in case that the part $P_D$ has about two times as large area on the one end surface of the piezoelectric vibrator 1 as the part $P_F$, an area between the parts $P_D$ and $P_F$ on the one end surface of the piezoelectric vibrator 1 is located parallel to the length direction of the piezoelectric vibrator 1, and the vibrating plate 2 is mounted on an edge of the electrode G in parallel to the width direction of the piezoelectric vibrator 1. If a direct current voltage of, for example, 0~10 V is supplied from the direct current power supply $V_{dc}$ to the self-oscillator circuit 7, and the value of the coil $L_1$ is regulated, an alternating current voltage of approximately 60 $V_{p-p}$, which is the maximum value, is applied to the electrode terminals $T_D$ and $T_G$. At this time, an alternating current voltage of approximately 1 $V_{p-p}$ is taken out at the electrode terminals $T_F$ and $T_G$. Thus, it is possible to supply the vibrating assembly with an alternating current voltage having about 6 times of the direct current voltage of the direct current power supply $V_{dc}$. In addition, it is possible to atomize a liquid under continuous-stable condition over a long time, and produce minute and uniform particles under low voltage operation with low power consumption.

Figure 6:
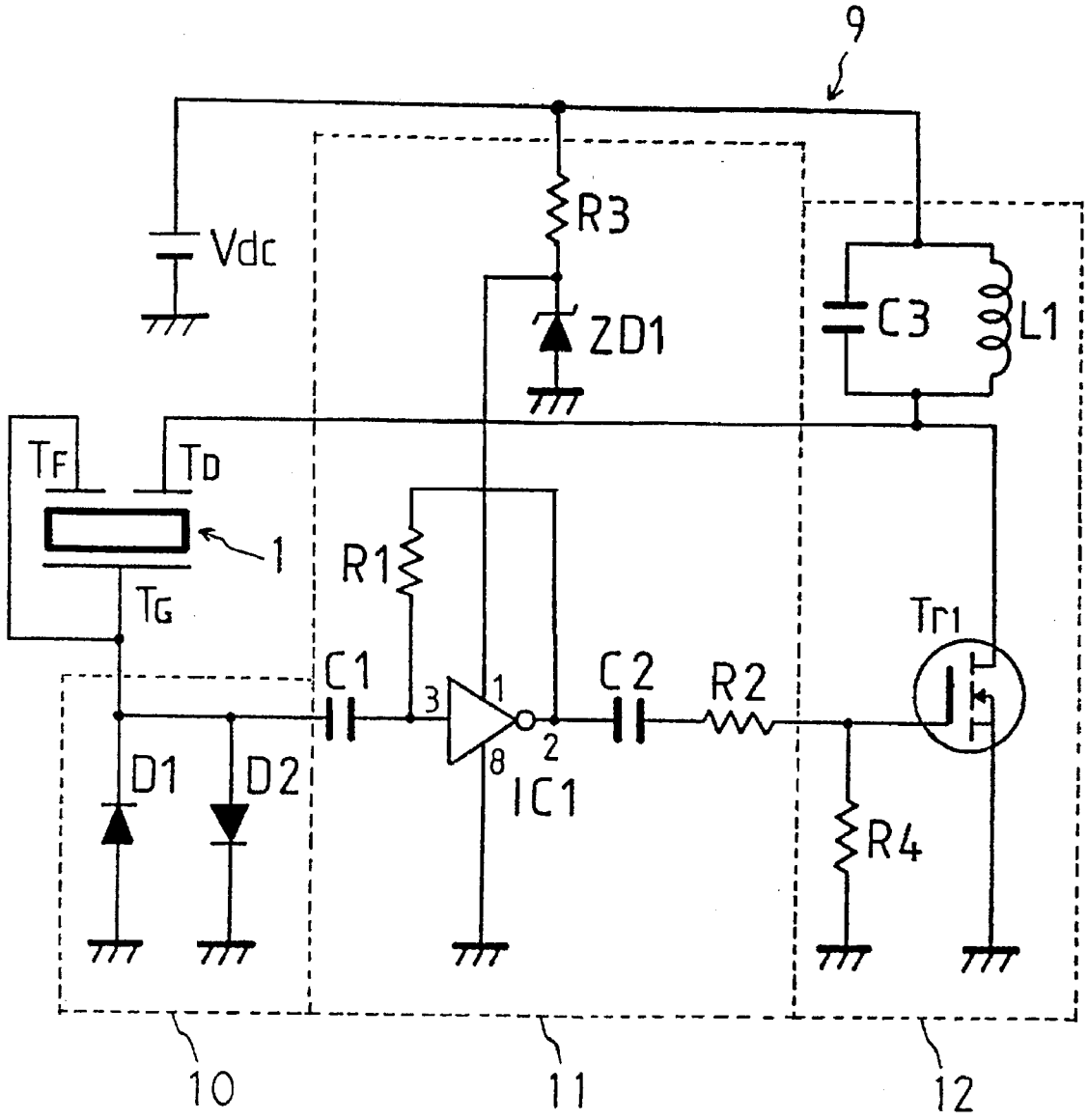
FIG. 6 shows a diagram of the self-oscillator circuit 9 used instead of the self-oscillator circuit 7.

FIG. 6 shows a diagram of a self-oscillator circuit 9 used instead of the self-oscillator circuit 7. The self-oscillator circuit 9 contains a direct current power supply $V_{dc}$, a current pick up circuit 10, a voltage amplifying circuit 11 and a power amplification circuit 12. The self-oscillator circuit 9 has been confirmed to work for continuous and stable acoustic vibration of the piezoelectric vibrator 1 without special compensation, for considerably large resonance frequency deviation of the piezoelectric vibrator 1 in the temperature range below 80° C. The current pick up circuit 10 comprises a first diode $D_1$ connected in series to the electrode terminals $T_F$ and $T_G$, and a second diode $D_2$ connected in parallel to the first diode $D_1$ with the opposite polarity to the first diode $D_1$, the current pick up circuit 10 picking up a phase of a current between the electrode terminals $T_F$ and $T_G$. Thus, an electric signal, in which a phase between current and voltage is zero and having a frequency corresponding to a frequency substantially equal to one of the resonance frequencies of the vibrating assembly, is delivered from the electrode terminals $T_F$ and $T_G$ toward the current pick up circuit 10. In proportion as an impedance of the current pick up circuit 10 is larger, the voltage provided to the piezoelectric vibrator 1 becomes lower. Therefore, the current pick up circuit 10 is favorable to have a smaller impedance. However, if the impedance is too small, the detected voltage becomes low. Accordingly, the rise time for self-oscillation becomes late. Generally, a diode acts as a high-resistance when self-oscillation begins and then the voltage is low, and as a low-resistance when self-oscillation is stabilized and then the voltage is high, considering the relationship between the current and the voltage in the diode. Accordingly, the diodes $D_1$ and $D_2$ are favorable as elements in the current pick up circuit 10. The voltage amplifying circuit 11 includes an inverter $IC_1$, condensers $C_1$ and $C_2$ for cutting the direct current component, a Zener diode $ZD_1$, and resistances $R_1$, $R_2$ and $R_3$. The voltage amplifying circuit 11 is intended for amplifying a weak voltage signal picked up by the current pick up circuit 10 and driving the next circuit, that is the power amplification circuit 12. For the purpose of obtaining enough high-frequency power to drive the piezoelectric vibrator 1 when a power amplifying means is composed of a transistor and so on, a voltage amplifying circuit with an amplifier is necessary for obtaining a large gain at high speed. In FIG. 6, the inverter $IC_1$ composed of CMOS logic IC is used. When feedbacking the inverter $IC_1$ via the resistance $R_1$, the voltage amplifying circuit 11 does not work around the threshold. Thus, the voltage amplifying circuit 11 acts as an analog amplifier. Though the voltage amplifying circuit 11 has a large gain at high speed, there is a limit of a voltage in the power supply. Therefore, the inverter $IC_1$ is supplied with a fixed voltage by using the Zener diode $ZD_1$. The power amplification circuit 12 includes a transistor $T_{r1}$, a coil $L_1$, a condenser $C_3$ and a resistance $R_4$, an output power of the power amplification circuit 12 being applied through the electrode terminals $T_D$ and $T_G$. The transistor $T_{r1}$ is for switching, and uses a power MOSFET in consideration of a switching speed and a simplicity of driving. The coil $L_1$ is used for supplying the piezoelectric vibrator 1 with a power having a voltage higher than the power supply voltage by generating an electromotive force. The condenser $C_3$ is for regulating the time constant of electromotive force. When enhancing the condenser $C_3$, the time constant becomes larger and the maximum voltage is lower. When reducing condenser $C_3$, the time constant is smaller and the maximum voltage is higher.

Figure 7:
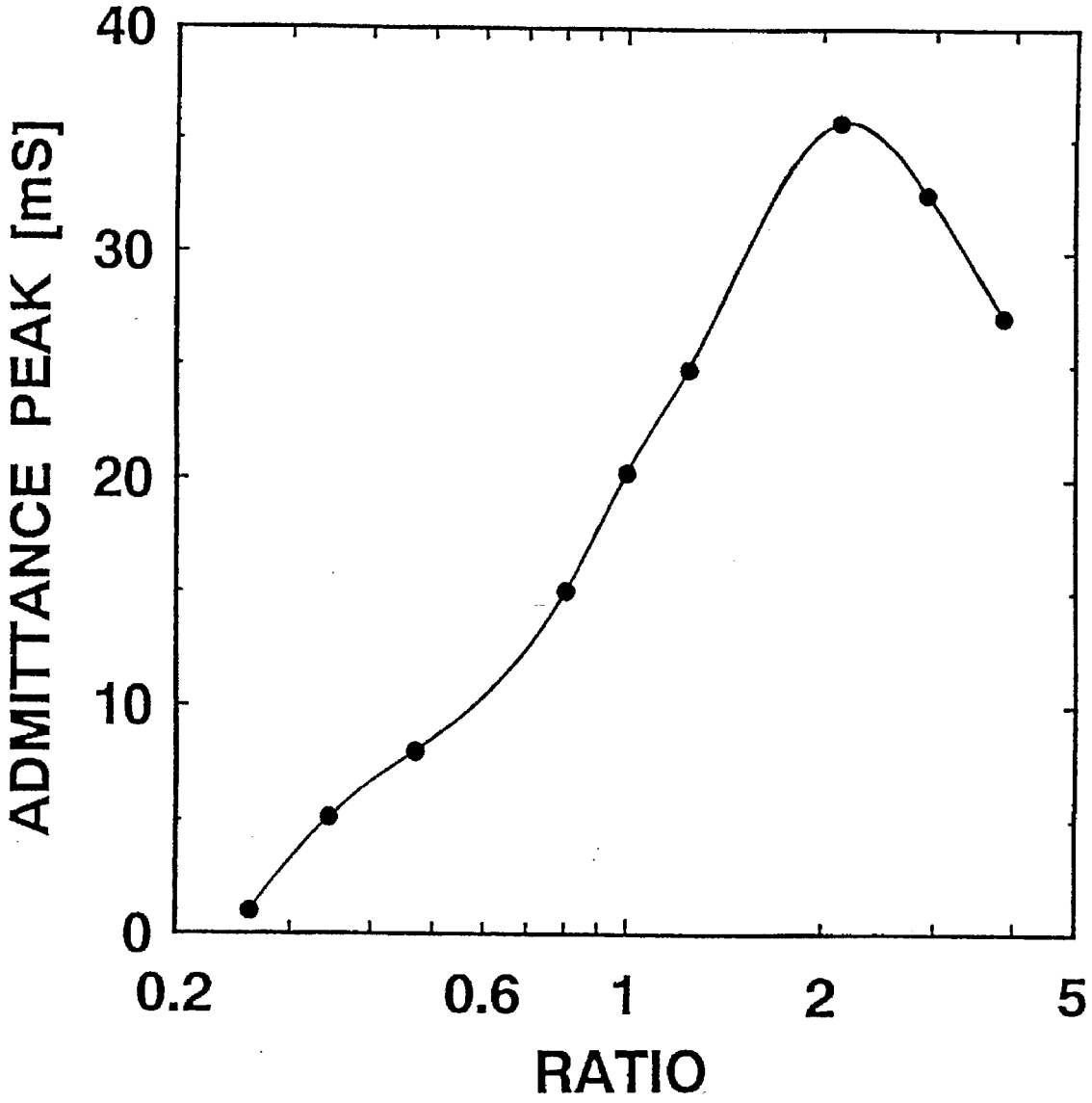
FIG. 7 shows the relationship between the area ratio of the part $P_D$ to the part $P_F$ on the one end surface of the piezoelectric vibrator 1, and the admittance peak, between the part $P_D$ and the electrode G at a frequency approximately equal to a resonance frequency of the piezoelectric vibrator 1, shown in FIG. 2.

FIG. 7 shows the relationship between the area ratio of the part $P_D$ to the part $P_F$ on the one end surface of the piezoelectric vibrator 1, and the admittance peak, between the part $P_D$ and the electrode G at a frequency approximately equal to a resonance frequency of the piezoelectric vibrator 1, shown in FIG. 2. The admittance peak has the maximum value, around 36 mS, when the part $P_D$ has approximately two times as large area as the part $P_F$.

Figure 8:
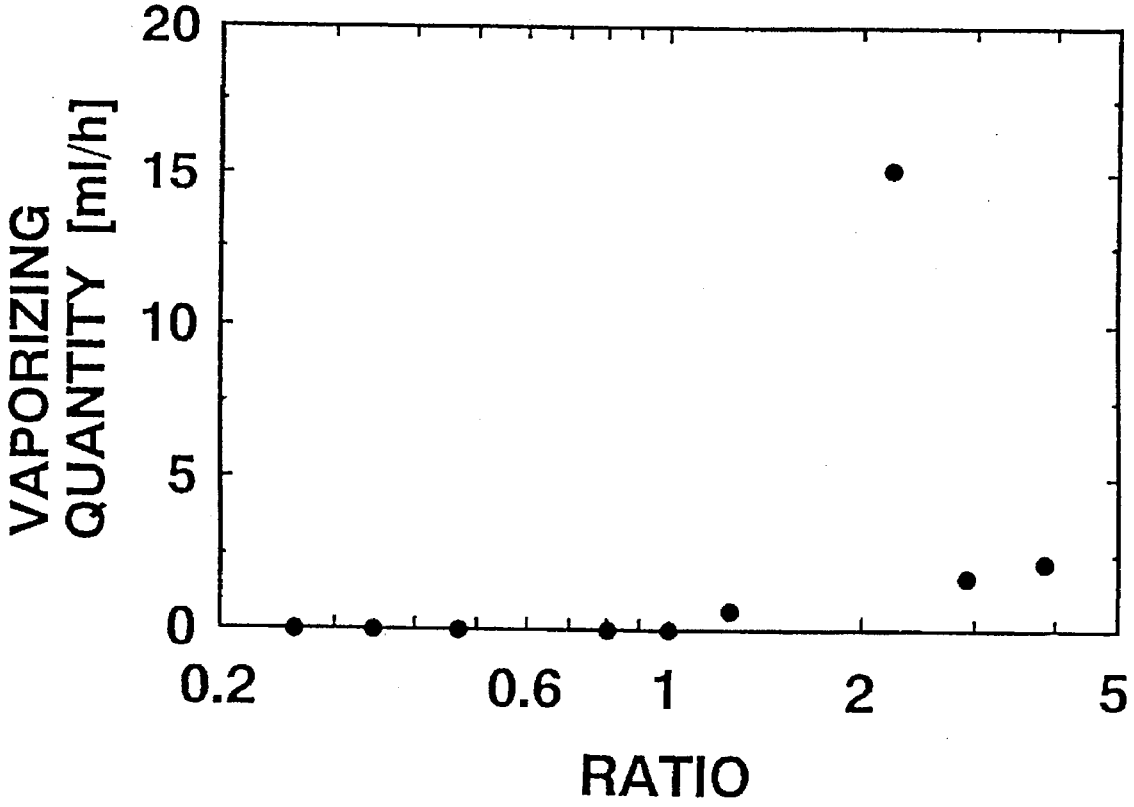
FIG. 8 shows the relationship between the area ratio of the part $P_D$ to the part $P_F$ on the one end surface of the piezoelectric vibrator 1, shown in FIG. 2, and the vaporizing quantity.

FIG. 8 shows the relationship between the area ratio of the part $P_D$ to the part $P_F$ on the one end surface of the piezoelectric vibrator 1, shown in FIG. 2, and the vaporizing quantity. FIG. 8 is provided that the voltage of the direct current power supply $V_{dc}$ in the self-oscillator circuit 7 is 9 V. When the part $P_D$ has approximately two times as large area as the part $P_F$, the vaporizing quantity has the maximum value, approximately 15 ml/h, which corresponds to the maximum value of the admittance peak shown in FIG. 7.

Figure 9:
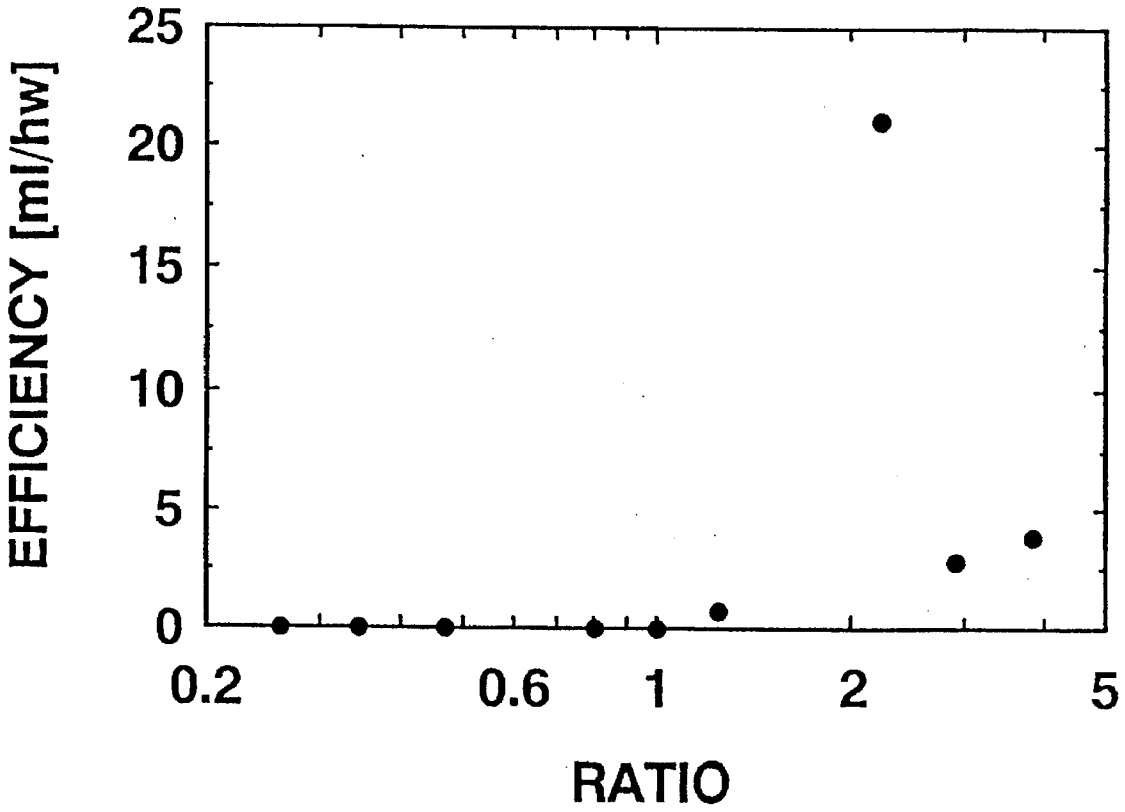
FIG. 9 shows the relationship between the area ratio of the part $P_D$ to the part $P_F$ on the one end surface of the piezoelectric vibrator 1, shown in FIG. 2, and the vaporizing efficiency.

FIG. 9 shows the relationship between the area ratio of the part $P_D$ to the part $P_F$ on the one end surface of the piezoelectric vibrator 1, shown in FIG. 2, and the vaporizing efficiency. FIG. 9 is provided that the voltage of the direct current power supply $V_{dc}$ in the self-oscillator circuit 7 is 9 V. When the part $P_D$ has approximately two times as large area as the part $P_F$, the vaporizing efficiency has the maximum value, approximately 22.5 ml/hw, which corresponds to the maximum value of the admittance peak shown in FIG. 7.

Figure 10:
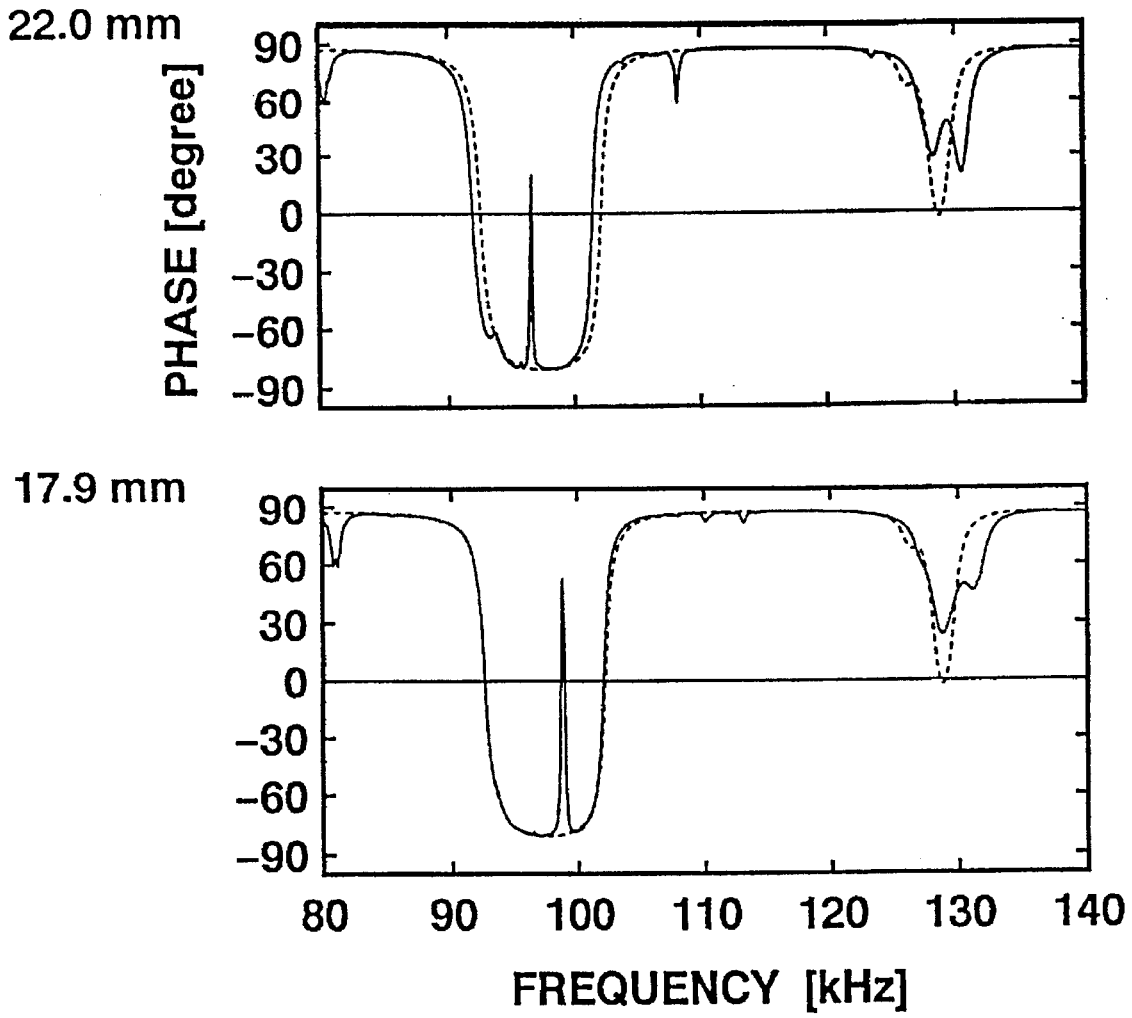
FIG. 10 shows the frequency dependence of the phase of the admittance between the part $P_D$ and the electrode G in the vibrating assembly or the piezoelectric vibrator 1 alone, shown in FIG. 2.

FIG. 10 shows the frequency dependence of the phase of the admittance between the part $P_D$ and the electrode G in the vibrating assembly (continuous line) or the piezoelectric vibrator 1 alone (dotted line), shown in FIG. 2. FIG. 10 is provided that the dimension of the second surface portion of the vibrating plate 2 is 22 mm or 17.9 mm in length. The agreement between the resonance frequency of the vibrating assembly and that of the piezoelectric vibrator 1 alone is essential for the most practical atomization. A resonance frequency of the vibrating assembly containing the vibrating plate 2, of which the second surface portion has the dimension of 17.9 mm in length, is around 92.5 kHz, which agrees with a resonance frequency of the piezoelectric vibrator 1 alone.

Figure 11:
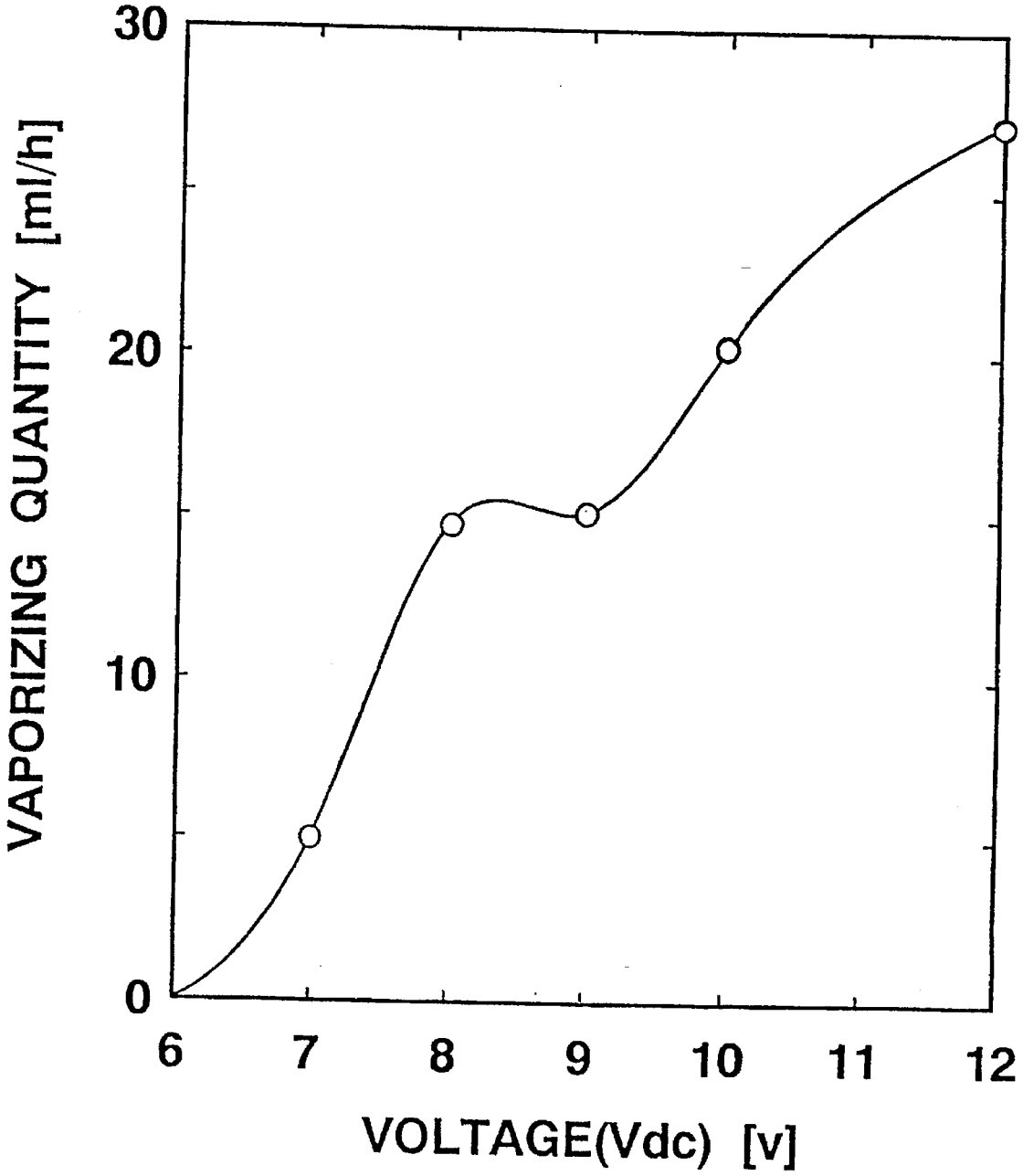
FIG. 11 shows the relationship between the vaporizing quantity and the voltage of the direct current power supply $V_{dc}$ in the self-oscillator circuit 7.

FIG. 11 shows the relationship between the vaporizing quantity and the voltage of the direct current power supply $V_{dc}$ in the self-oscillator circuit 7. FIG. 11 is provided that the dimension of the second surface portion of the vibrating plate 2 is 17.9 mm in length. As the voltage approaches 7 V or higher, fog can be blown out from the vibrating plate 2. Thus, a stabilized and very efficient atomization under very low power consumption with very low voltage can be realized.

Figure 12:
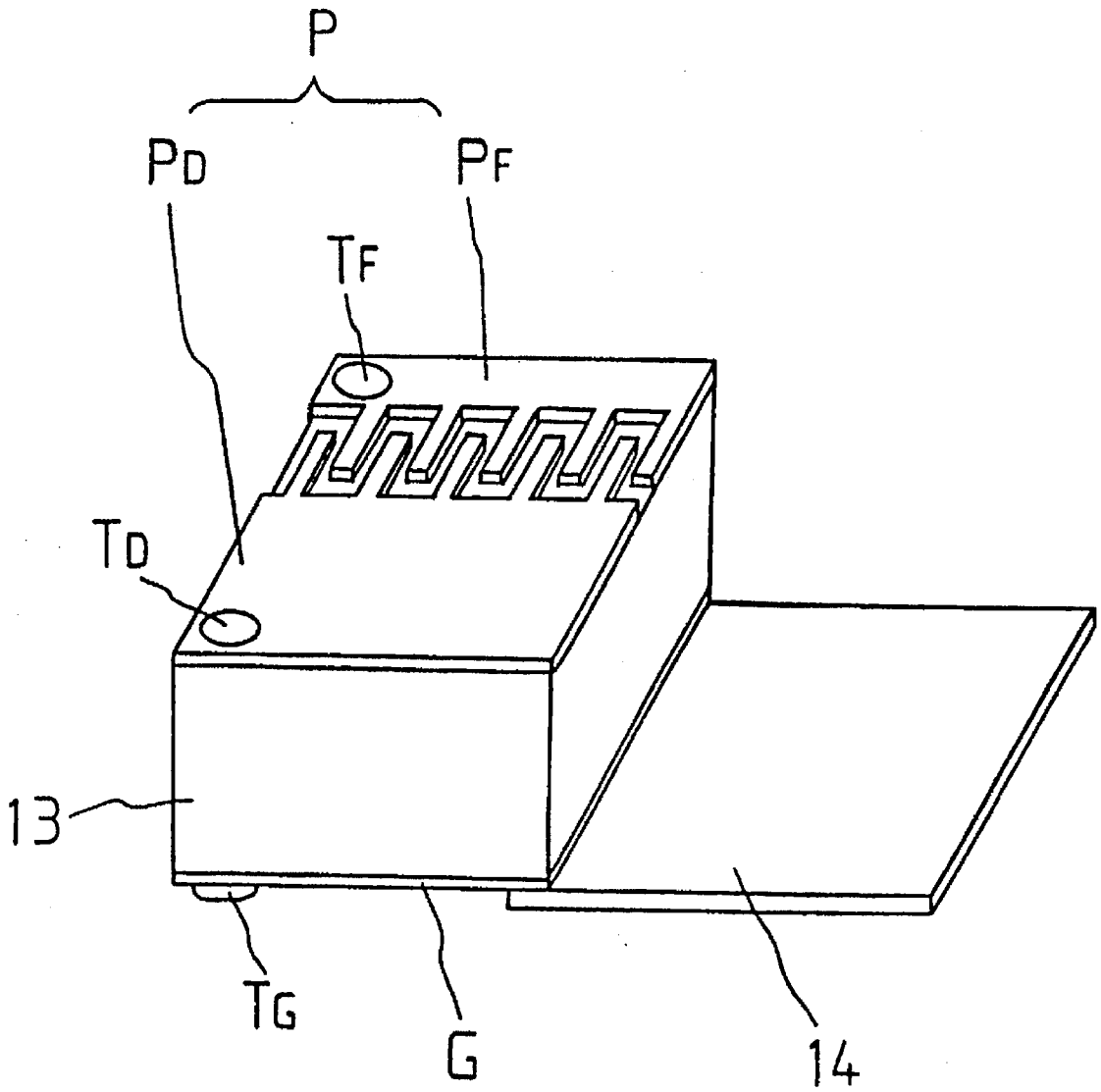
FIG. 12 shows a perspective view of another embodiment of the vibrating assembly, shown in FIG. 2.

FIG. 12 shows a perspective view of another embodiment of the vibrating assembly, shown in FIG. 2. The vibrating assembly shown in FIG. 12 comprises a piezoelectric vibrator 13, a vibrating plate 14, an interdigital transducer P comprising two parts $P_D$ and $P_F$, and an electrode G. The piezoelectric vibrator 13 has a rectangular pillar-shaped body made of a TDK-91A piezoelectric ceramic (TDK Company) providing a high electromechanical coupling constant, and having dimensions of 10 mm in length, 5 mm in width and 6 mm in thickness. The piezoelectric vibrator 13 has two end surfaces running perpendicular to the thickness direction thereof. The direction of the polarization axis of the piezoelectric vibrator 13 is parallel to the thickness direction thereof. The interdigital transducer P is formed on one end surface of the piezoelectric vibrator 13. The part $P_D$ has about two times as large area on the one end surface of the piezoelectric vibrator 13 as the part $P_F$. The electrode G is formed on the other end surface of the piezoelectric vibrator 13. The parts $P_D$, $P_F$ and the electrode G are provided with the electrode terminals $T_D$, $T_F$ and $T_G$, respectively. Each electrode terminal $T_D$, $T_F$ or $T_G$, is mounted at one edge along the width direction of the piezoelectric vibrator 13. The vibrating plate 14 made of stainless steel has a first surface portion and a second surface portion, the first surface portion being cemented to the piezoelectric vibrator 13 with an electroconductive epoxy resin (Dotite, Fujikura Chemical) in contact with the electrode G. The dimensions of the vibrating plate 14 are 11 mm in length, 5 mm in width and 0.04 mm in thickness. The dimensions of the first surface portion of the vibrating plate 14 are 1.5 mm in length and 5 mm in width. Thus, the second surface portion which is not cemented to the piezoelectric vibrator 13 has dimensions of 9.5 mm in length and 5 mm in width.

The vibrating assembly shown in FIG. 12 has the same atomizing effect as the vibrating assembly shown in FIG. 2. The best self-oscillation is realized in case that the part $P_D$ has about two times as large area on the one end surface of the piezoelectric vibrator 13 as the part $P_F$, an area between the parts $P_D$ and $P_F$ on the one end surface of the piezoelectric vibrator 13 is located parallel to the length direction of the piezoelectric vibrator 13, and the vibrating plate 14 is mounted on an edge of the electrode G in parallel to the width direction of the piezoelectric vibrator 13. The vibrating assembly shown in FIG. 12 has the piezoelectric vibrator 13 with a rectangular pillar-shaped body, the ratio of width to thickness thereof being substantially equal to 1. Therefore, a coupled-mode vibration of the vibrating assembly is strengthened. In addition, the first surface portion of the vibrating plate 14 is cemented and integrally interlocked with one end surface of the piezoelectric vibrator 13. Accordingly, the acoustic vibration can be transmitted to all the vibrating plate 14 over effectively through the first surface portion acting as a cemented end. The vibrating assembly shown in FIG. 12 provides an ultrasonic atomizing device which is operated under very low voltages with very low power consumption and is not affected by the resonance frequency variation associated with temperature change, causing continuous-stable liquid atomization.

Figure 13:
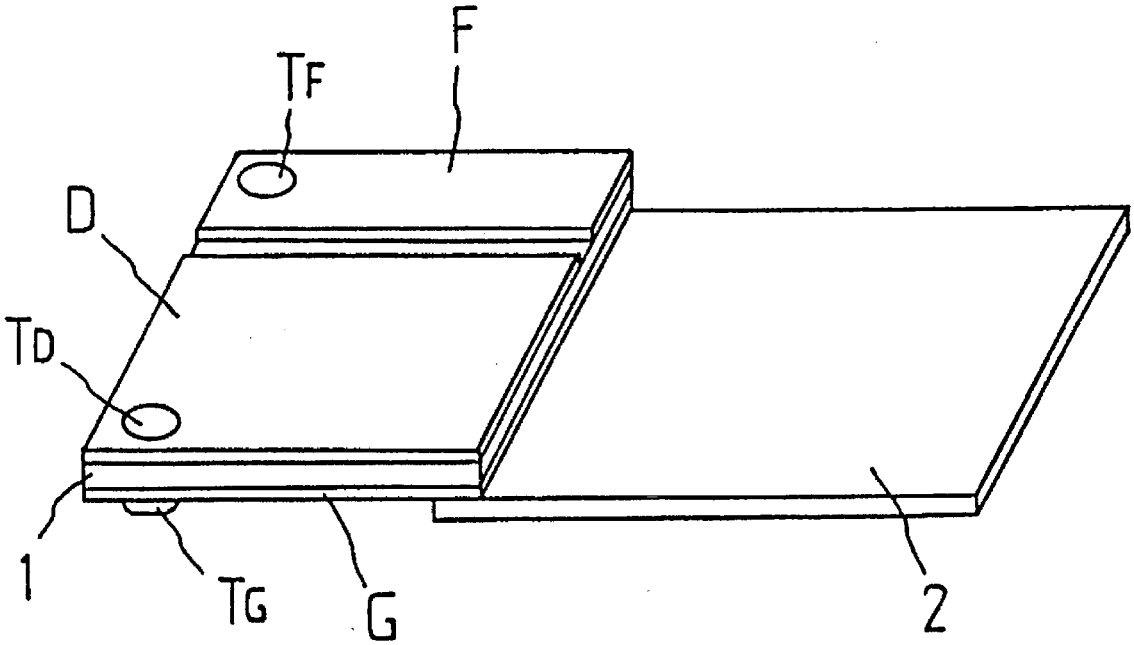
FIG. 13 shows a perspective view of still another embodiment of the vibrating assembly, shown in FIG. 2.

FIG. 13 shows a perspective view of still another embodiment of the vibrating assembly, shown in FIG. 2. The vibrating assembly, shown in FIG. 13 comprises the piezoelectric vibrator 1, the vibrating plate electrodes D, F and G made from aluminium thin film. Electrode terminals $T_D$, $T_F$ and $T_G$, made from copper ribbon, are cemented on the electrodes D, F and G, respectively, by an adhesive agent which is of high conductivity. The electrodes D and F are formed on one end surface of the piezoelectric vibrator 1 with electrically Separated condition each other. In this time, the electrode D has four times as large area on the one end surface of the piezoelectric vibrator 1 as the electrode F. The electrode G is formed on the other end surface of the piezoelectric vibrator 1. Each electrode terminal $T_D$, $T_F$ or $T_G$, is mounted at one edge along the width direction of the piezoelectric vibrator 1.

Figure 14:
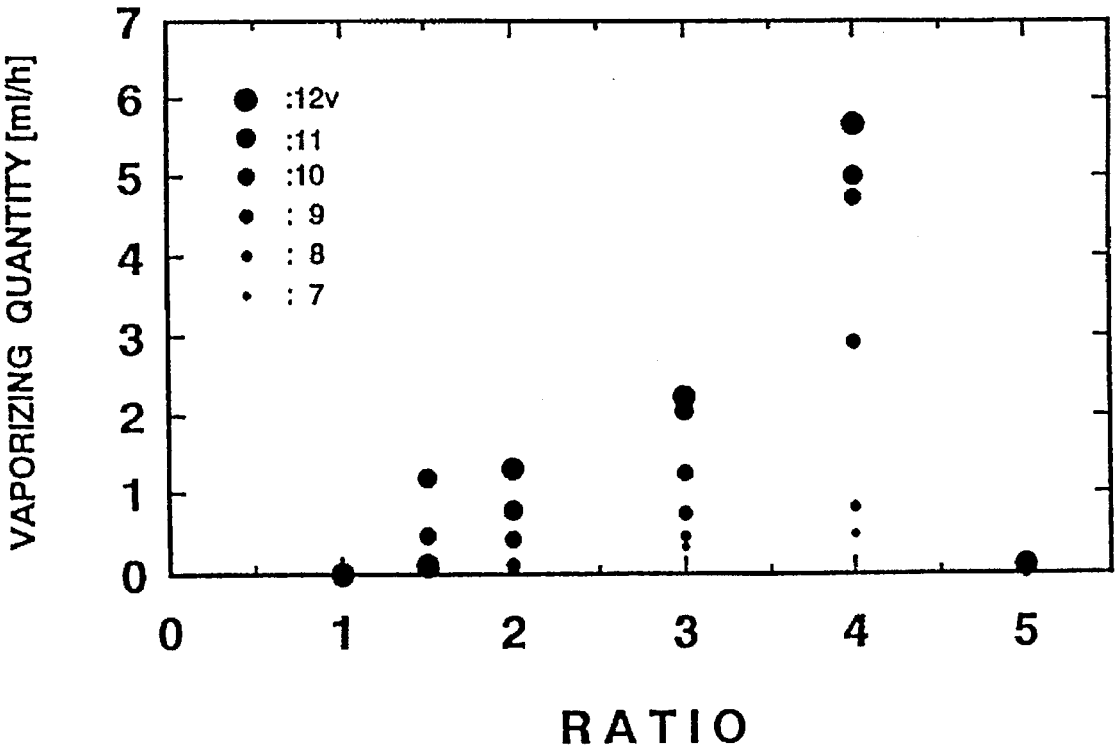
FIG. 14 shows the relationship between the vaporizing quantity and the area ratio of the electrode D on the one end surface of the piezoelectric vibrator 1 to the electrode F, shown in FIG. 13.

FIG. 14 shows the relationship between the vaporizing quantity and the area ratio of the electrode D on the one end surface of the piezoelectric vibrator 1 to the electrode F, shown in FIG. 13. FIG. 14 is provided that the vibrating plate 2 has the second surface portion with a dimension of 18.0 mm in length, and the electrode D has one, two, three four or five times as large area on the one end surface of the piezoelectric vibrator 1 as electrode F. Each circle in FIG. 14 corresponds to a direct current voltage of 12, 11, 10, 9, 8 or 7 V, supplied from the direct current power supply $V_{dc}$ in the self-oscillator circuit 7 to the vibrating assembly. The vaporizing quantity yields a maximum value of 5.7 ml/h, when applying the self-oscillator circuit 7 with a direct current voltage of 12 V, and the electrode D on the one end surface of the piezoelectric vibrator 1 has four times as large area as the electrode F. The vibrating assembly having the piezoelectric vibrator 1 with the same area on the one end surface thereof as the electrode F or with five times as large area on the one end surface thereof as the electrode F, has little or no vaporizing ability.

In the vibrating assembly shown in FIG. 13, the best self-oscillation is realized in case that the electrode D has about three to four times as large area on the one end surface of the piezoelectric vibrator 1 as the electrode F, a linear area between the electrodes D and F on the one end surface of the piezoelectric vibrator 1 is located parallel to the length direction of the piezoelectric vibrator 1, and the vibrating plate 2 is mounted on an edge of the electrode G in parallel to the width direction of the piezoelectric vibrator 1. The vibrating assembly shown in FIG. 13 provides an ultrasonic atomizing device which is operated under very low voltage with very low power consumption and is not affected by the resonance frequency variation associated with temperature change, causing continuous-stable liquid atomization.

Figure 15:
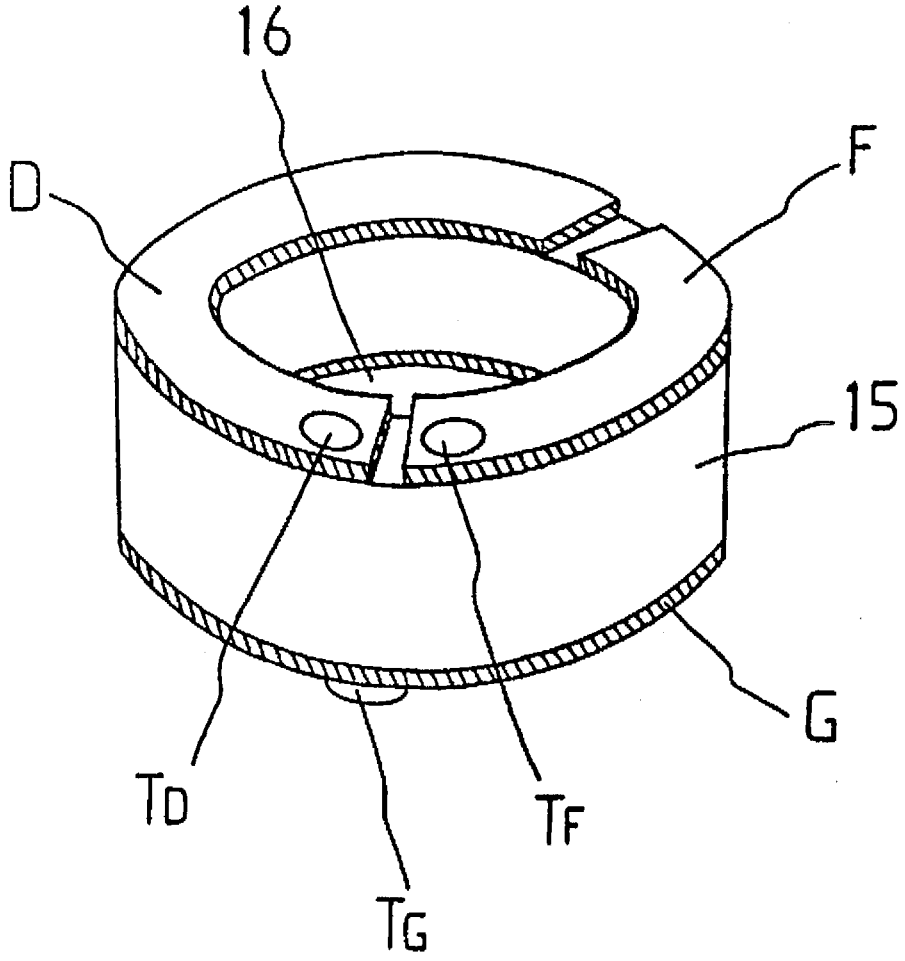
FIG. 15 shows a perspective view of further embodiment of the vibrating assembly shown in FIG. 2.

FIG. 15 shows a perspective view of further embodiment of the vibrating assembly shown in FIG. 2. The vibrating assembly shown in FIG. 15 comprises a piezoelectric vibrator 18, a vibrating plate electrodes D and F, formed on one end surface of the piezoelectric vibrator 15 with electrically separated condition each other, an electrode G formed on the other end surface of the piezoelectric vibrator 15. The electrodes D, F and G, are made from aluminium thin film. Electrode terminals $T_D$, $T_F$ and $T_G$, are made from copper ribbon and cemented on the electrodes D, F and G, respectively, by an adhesive agent which is of high conductivity. The piezoelectric vibrator 15 made of a TDK-91A piezoelectric ceramic (TDK Company) providing a high electromechanical coupling constant has a cylindrical shaped body, with dimensions of 4 mm in thickness and 14 mm in diameter, and having a cylindrical-shaped pierced hole therein parallel to the thickness direction thereof and with dimensions of 4 mm in thickness and 8 mm in diameter. The direction of the polarization axis of the piezoelectric vibrator 15 is parallel to the thickness direction thereof. The electrode D has about three times as large area on the one end surface of the piezoelectric vibrator 15 as the electrode F. The vibrating plate 16 made of stainless steel having a disk-like body has a first surface portion and a second surface portion on one end surface thereof, the first surface portion being cemented to the piezoelectric vibrator 15 with an electroconductive epoxy resin (Dotite, Fujikura Chemical) and in contact with the electrode G such that the vibrating plate 16 is mounted at a position which covers the opening of the pierced hole of the piezoelectric vibrator 15, the second surface portion being surrounded by the ring-like first surface portion. The dimensions of the vibrating plate 16 are 10 mm in diameter and 0.05 mm in thickness.

Figure 16:
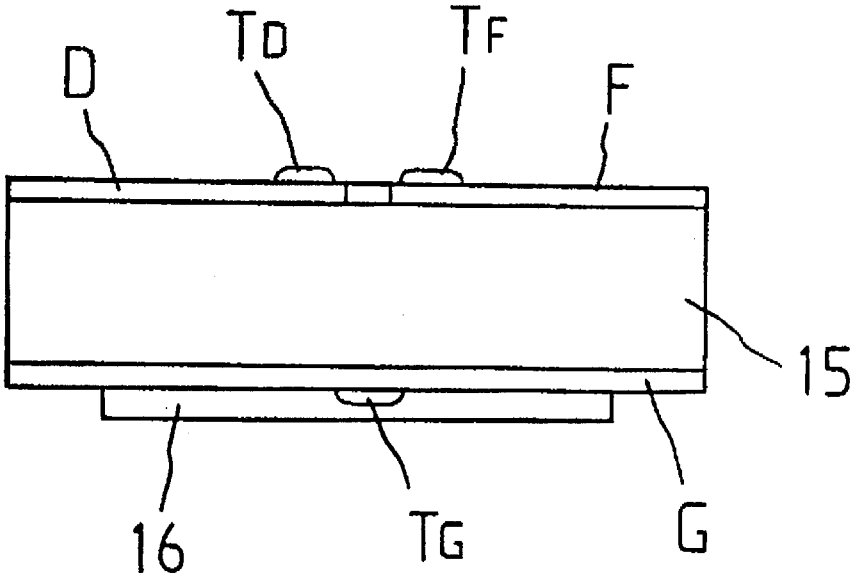
FIG. 16 shows a side view of the vibrating assembly shown in FIG. 15.

FIG. 16 shows a side view of the vibrating assembly shown in FIG. 15. The vibrating assembly shown in FIG. 15 has the same atomizing effect as the vibrating assembly shown in FIG. 2. The vibrating assembly shown in FIG. 15 has the piezoelectric vibrator 15 with a pillar-shaped body having a pierced hole located parallel to the thickness direction of the piezoelectric vibrator 15, the ratio of the dimension in thickness to the shortest distance between the outer edge and the inner edge of an end surface of the piezoelectric vibrator 15 being approximately equal to 1. Therefore, a coupled-mode vibration of the vibrating assembly is strengthened. Thus, acoustic vibration can be transmitted to all the vibrating plate 16 over. Therefore, the vibrating plate 16 can be made to vibrate effectively.

Figure 17:
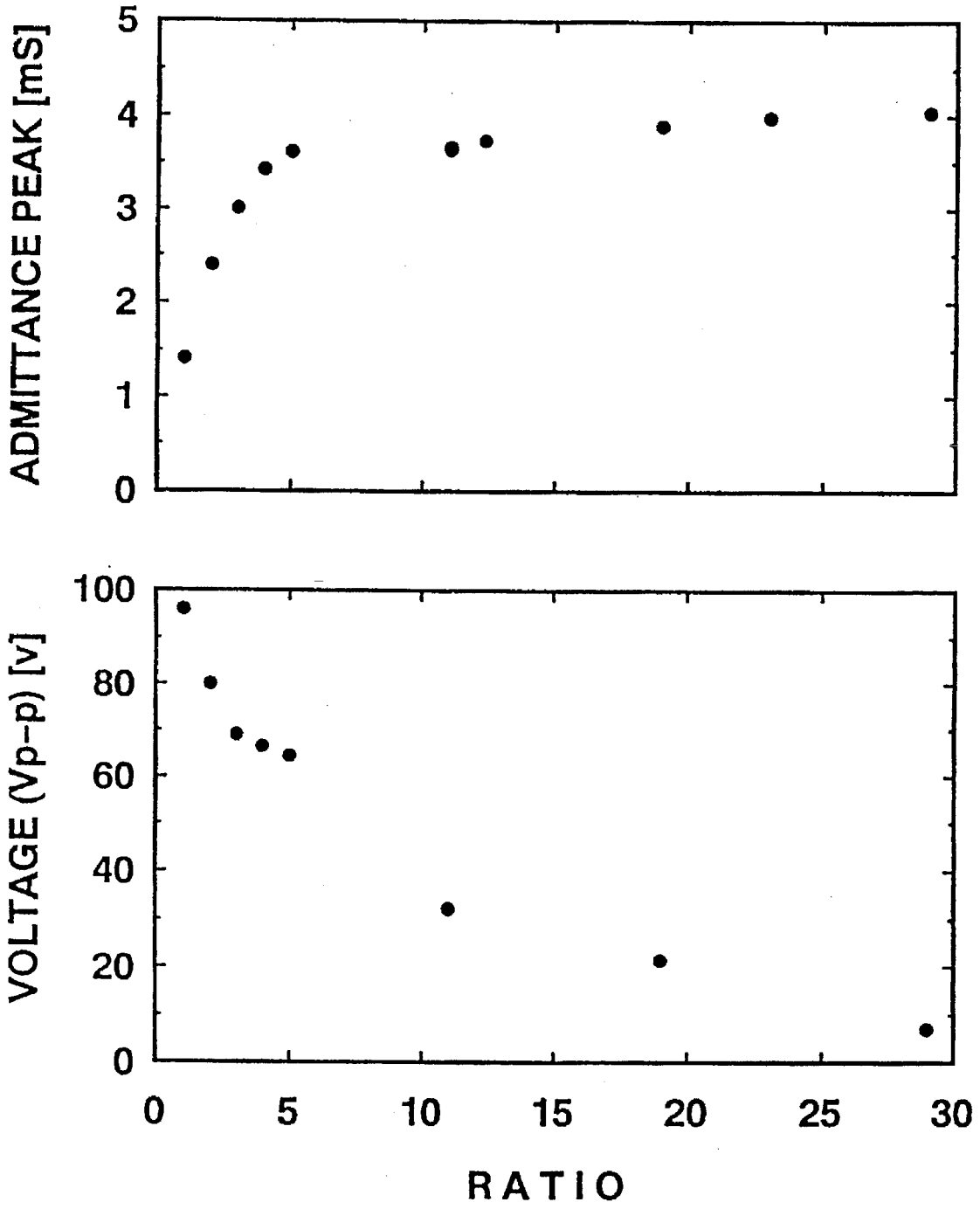
FIG. 17 shows the relationship between the area ratio of the electrode D on the one end surface of the piezoelectric vibrator 15 to the electrode F, and the admittance peak between the electrodes D and G, or the amplitude of the alternating current voltage applied to the electrode D shown in FIG. 15.

FIG. 17 shows the relationship between the area ratio of the electrode D on the one end surface of the piezoelectric vibrator 15 to the electrode F, and the admittance peak between the electrodes D and G, or the amplitude of the alternating current voltage applied to the electrode D shown in FIG. 15. FIG. 17 is provided that the voltage of the direct current power supply $V_{dc}$ in the self-oscillator circuit 7 is 9 V. When the electrode D has the same area as the electrode F, the amplitude of the alternating current voltage applied to the electrodes D is 97 $V_{p-p}$.

Figure 18:
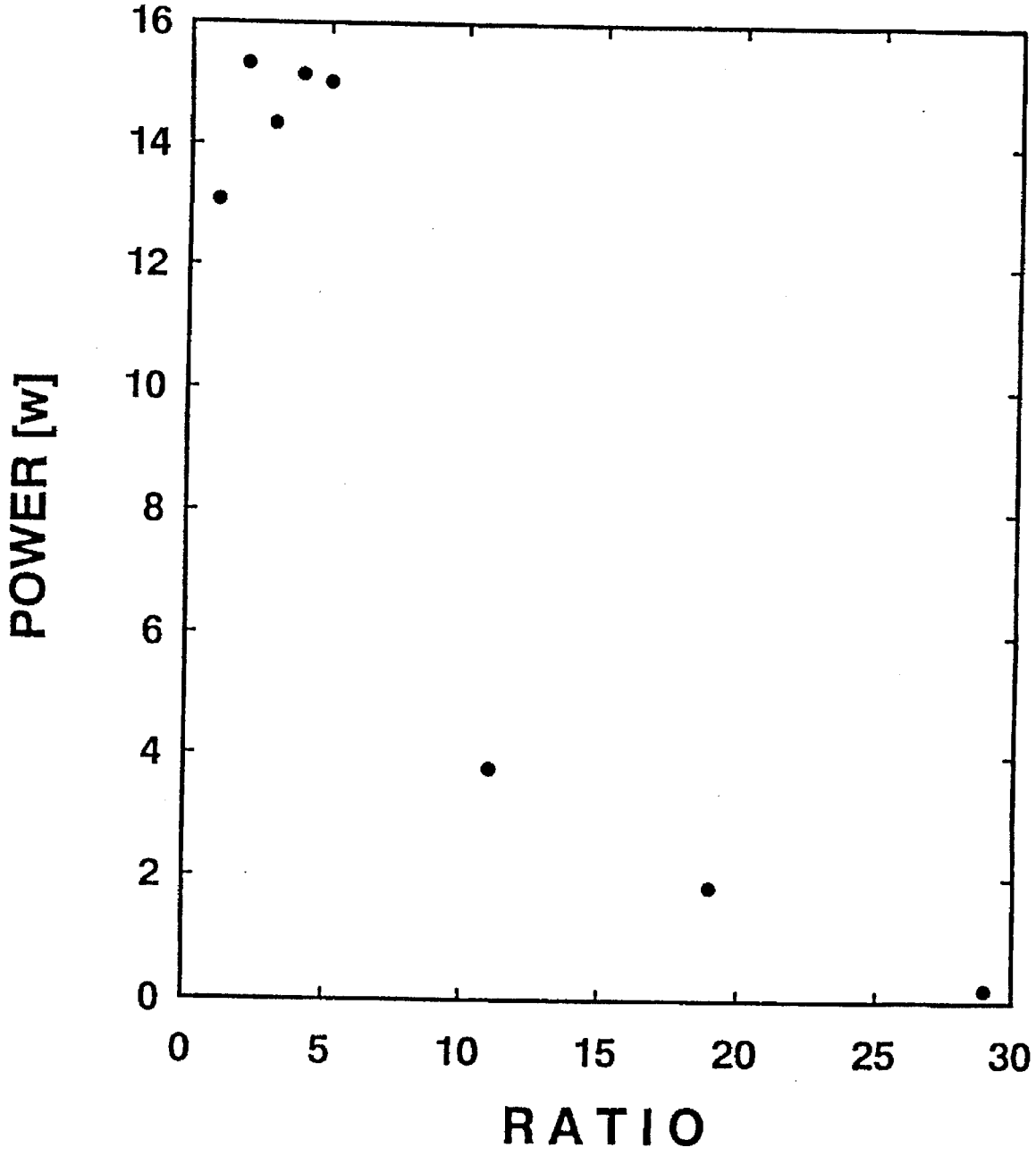
FIG. 18 shows the relationship between the area ratio of the electrode D on the one end surface of the piezoelectric vibrator 15 to the electrode F, and the electric power supplied to the electrode D shown in FIG. 15.

FIG. 18 shows the relationship between the area ratio of the electrode D on the one end surface of the piezoelectric vibrator 15 to the electrode F, and the electric power supplied to the electrode D shown in FIG. 15. FIG. 18 is provided that the voltage of the direct current power supply $V_{dc}$ in the self-oscillator circuit 7 is 9 V. When the electrode D has two times as large area as the electrode F, the electric power supplied to the electrode D is 15.5 W. Thus, particularly high electric power supplied to the electrode D is obtained, when the electrode D has one, two, three, four or five times as large area as the electrode F. Accordingly, it is possible to operate the vibrating assembly effectively under low voltage of the direct current power supply $V_{dc}$. Consequently, the vibrating assembly can be made to operate effectively, when the electrode D has the same area on the one end surface of the piezoelectric vibrator 15 as the electrode F, or the area not only more than the same as the electrode F but also less than five times the electrode F.

Figure 19:
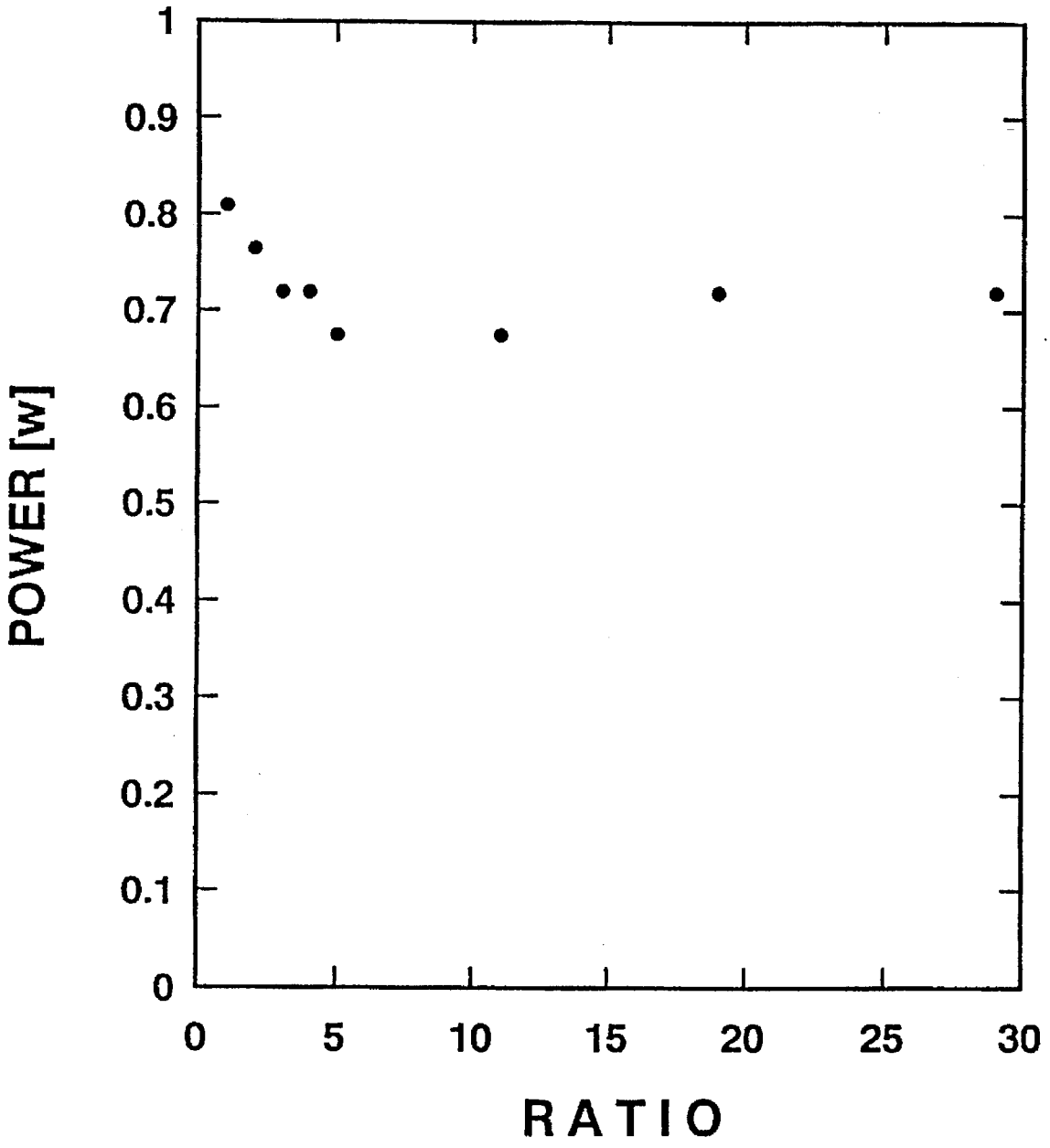
FIG. 19 shows the relationship between the power consumption at the direct current power supply $V_{dc}$ in the self-oscillator circuit, and the area ratio of the electrode D on the one end surface of the piezoelectric vibrator 15 to the electrode F, shown in FIG. 15.

FIG. 19 shows the relationship between the power consumption at the direct current power supply $V_{dc}$ in the self-oscillator circuit, and the area ratio of the electrode D on the one end surface of the piezoelectric vibrator 15 to the electrode F, shown in FIG. 15. FIG. 19 is provided that the voltage of the direct current power supply $V_{dc}$ is 9 V. When the electrode D has four or ten times as large area as the electrode F, the power consumption has the minimum value of 0.68 W. Thus, the vibrating assembly shown in FIG. 15 provides an ultrasonic atomizing device which is operated under very low voltage with very low power consumption and is not affected by the resonance frequency variation associated with temperature change, causing continuous-stable liquid atomization.

While this invention has been described in connection with what is presently considered to be the most practical and preferred embodiment, it is to be understood that the invention is not limited to the disclosed embodiment, but, on the contrary, is intended to cover various modifications and equivalent arrangements included within the spirit and scope of the appended claims.

What is claimed is:

1. An ultrasonic atomizing device comprising:

a piezoelectric vibrator having two end surfaces running perpendicular to the thickness direction of said piezoelectric vibrator;

at least an interdigital transducer (P) formed on one end surface of said piezoelectric vibrator, said interdigital transducer (P) comprising a first part ($P_D$), and a second part ($P_F$), said first of said parts ($P_D$) having about two times as large an area on said one end surface of said piezoelectric vibrator as the second of said parts ($P_F$);

at least an electrode (G), formed on the other end surface of said piezoelectric vibrator;

first and second electrode terminals ($T_{D\ and\ TF}$) formed on said first and second parts ($P_D$ and $P_F$), respectively;

an electrode terminal ($T_G$) formed on said electrode (G);

a vibrating plate having a plurality of holes and connected to said electrode (G);

a self-oscillator circuit; and means for dispensing a liquid to said plurality of holes, said piezoelectric vibrator, said vibrating plate, said interdigital transducer (P), and said electrode (G) forming a vibrating assembly, said first electrode terminal ($T_D$) and said electrode terminal ($T_G$) receiving an electric signal with a frequency approximately equal to a resonance frequency of said vibrating assembly and causing said piezoelectric vibrator to vibrate acoustically, said piezoelectric vibrator causing said vibrating plate to vibrate acoustically and generating an electric signal between said second electrode terminal ($T_F$) and said electrode terminal ($T_G$), said second electrode terminal ($T_F$) and said electrode terminal ($T_G$) delivering said electric signal, generated between said second electrode terminal ($T_F$) and said electrode terminal ($T_G$) and having a frequency approximately equal to said resonance frequency of said vibrating assembly, said vibrating plate atomizing a liquid dispensed to said plurality of holes by the acoustic vibration of said vibrating plate, each of said plurality of holes having an inlet opening portion and an outlet opening portion, the liquid penetrating from said inlet opening portion to said outlet opening portion during atomizing the liquid, the circumference of said inlet opening portion being larger than that of said outlet opening portion, said self-oscillator circuit comprising a direct current power supply ($V_{dc}$), a coil ($L_1$) connected between said direct current power supply ($V_{dc}$) and said first electrode terminal ($T_D$), and a transistor ($T_{r1}$), output terminal thereof being connected to said first electrode terminal ($T_D$) and input terminal thereof being connected to said second electrode terminal ($T_F$), said vibrating assembly acting as a resonance element and said transistor ($T_{r1}$) acting as a feedback amplifier element, said means for dispensing a liquid to said plurality of holes comprising a supporting material upholding said piezoelectric vibrator and having a lower acoustic impedance compared with that of said piezoelectric vibrator, a sponge-like liquid-keeping material having a lower acoustic impedance compared with that of said piezoelectric vibrator, and a large absorption ability for dispensing a liquid to said inlet opening portion of said plurality of holes, said inlet opening portion being in contact with said sponge-like liquid-keeping material, and a liquid bath for accommodating said sponge-like liquid-keeping material and supplying said sponge-like liquid-keeping material with a liquid, said piezoelectric vibrator having a rectangular plate-shaped body, the ratio of length to width thereof being substantially equal to 1, an area between said first and second parts ($P_D$ and $P_F$) on said one end surface of said piezoelectric vibrator being located parallel to the length direction of said piezoelectric vibrator, and said vibrating plate being mounted on an edge of said electrode (G) in parallel to the width direction of said piezoelectric vibrator.

2. An ultrasonic atomizing device comprising:

a piezoelectric vibrator having two end surfaces running perpendicular to the thickness direction of said piezoelectric vibrator;

at least an interdigital transducer (P) formed on one end surface of said piezoelectric vibrator, said interdigital transducer (P) comprising a first part ($P_D$), and a second part ($P_F$), said first of said parts ($P_D$) having about two times as large an area on said one end surface of said piezoelectric vibrator as the second of said parts ($P_F$);

at least an electrode (G), formed on the other end surface of said piezoelectric vibrator;

first and second electrode terminals ($T_D$ and $T_F$) formed on said first and second parts ($P_D$ and $P_F$), respectively;

an electrode terminal ($T_G$) formed on said electrode (G);

a vibrating plate having a plurality of holes and connected to said electrode (G);

a self-oscillator circuit; and means for dispensing a liquid to said plurality of holes, said piezoelectric vibrator, said vibrating plate, said interdigital transducer (P), and said electrode (G) forming a vibrating assembly, said first electrode terminal ($T_D$) and said electrode terminal ($T_G$) receiving an electric signal with a frequency approximately equal to a resonance frequency of said vibrating assembly and causing said piezoelectric vibrator to vibrate acoustically, said piezoelectric vibrator causing said vibrating plate to vibrate acoustically and generating an electric signal between said second electrode terminal ($T_F$) and said electrode terminal ($T_G$), said second electrode terminal ($T_F$) and said electrode terminal ($T_G$) delivering said electric signal, generated between said second electrode terminal ($T_F$) and said electrode terminal ($T_G$) and having a frequency approximately equal to said resonance frequency of said vibrating assembly, said vibrating plate atomizing a liquid dispensed to said plurality of holes by the acoustic vibration of said vibrating plate, each of said plurality of holes having an inlet opening portion and an outlet opening portion, the liquid penetrating from said inlet opening portion to said outlet opening portion during atomizing the liquid, the circumference of said inlet opening portion being larger than that of said outlet opening portion, said self-oscillator circuit comprising a direct current power supply ($V_{dc}$), a current pick up circuit comprising a first diode ($D_1$) connected in series to said second electrode terminal ($T_F$) and said electrode terminal ($T_G$), and a second diode ($D_2$) connected in parallel to said first diode ($D_1$) with the opposite polarity to said first diode ($D_1$), said current pick up circuit picking up a phase of a current between said second electrode terminal ($T_F$) and said electrode terminal ($T_G$), a voltage amplifying circuit including an inverter ($IC_1$) and amplifying a weak voltage picked up by said current pick up circuit, and a power amplification circuit including a transistor ($T_{r1}$) and a coil ($L_1$) for raising a voltage in a passage for applying said transistor ($T_{r1}$) with a direct current, an output power of said power amplification circuit being applied through said first electrode terminal ($T_D$) and said electrode terminal ($T_G$), said vibrating assembly acting as a resonance element and said transistor ($T_{r1}$) acting as a feedback amplifier element, said means for dispensing a liquid to said plurality of holes comprising a supporting material upholding said piezoelectric vibrator and having a lower acoustic impedance compared with that of said piezoelectric vibrator, a sponge-like liquid-keeping material having a lower acoustic impedance compared with that of said piezoelectric vibrator, and a large absorption ability for dispensing a liquid to said inlet opening portion of said plurality of holes, said inlet opening portion being in contact with said sponge-like liquid-keeping material, and a liquid bath for accommodating said sponge-like liquid-keeping material and supplying said sponge-like liquid-keeping material with a liquid, said piezoelectric vibrator having a rectangular pillar-shaped body, the ratio of length to width, length to thickness, or width to thickness thereof being substantially equal to 1, an area between said first and second parts ($P_D$ and $P_F$) on said one end surface of said piezoelectric vibrator being located parallel to the length direction of said piezoelectric vibrator, and said vibrating plate being mounted on an edge of said electrode (G) in parallel to the width direction of said piezoelectric vibrator.

3. An ultrasonic atomizing device comprising:

a piezoelectric vibrator having two end surfaces running perpendicular to the thickness direction of said piezoelectric vibrator;

at least first and second electrodes (D) and (F), formed on one end surface of said piezoelectric vibrator with electrically separated condition each other;

at least one electrode (G) formed on the other end surface of said piezoelectric vibrator;

first and second electrode terminals ($T_D$ and $T_F$) formed on said first and second electrodes (D and F), respectively;

an electrode terminal ($T_G$) formed on said electrode (G);

a vibrating plate having a plurality of holes and connected to said electrode (G);

a self-oscillator circuit; and means for dispensing a liquid to said plurality of holes, said piezoelectric vibrator, said vibrating plate, said first and second electrodes (D and F) and said electrode (G) forming a vibrating assembly, said first electrode terminal ($T_D$) and said electrode terminal ($T_G$) receiving an electric signal with a frequency approximately equal to a resonance frequency of said vibrating assembly and causing said piezoelectric vibrator to vibrate acoustically, said piezoelectric vibrator causing said vibrating plate to vibrate acoustically and generating an electric signal between said second electrode terminal ($T_F$) and said electrode terminal ($T_G$), said second electrode terminal ($T_F$) and said electrode terminal ($T_G$) delivering said electric signal, generated between said second electrode terminal ($T_F$) and said electrode terminal ($T_G$) and having a frequency approximately equal to said resonance frequency of said vibrating assembly, said vibrating plate atomizing a liquid dispensed to said plurality of holes by the acoustic vibration of said vibrating plate, each of said plurality of holes having an inlet opening portion and an outlet opening portion, the liquid penetrating from said inlet opening portion to said outlet opening portion during atomizing the liquid, the circumference of said inlet opening portion being larger than that of said outlet opening portion, said self-oscillator circuit comprising a direct current power supply ($V_{dc}$), a coil ($L_1$) connected between said direct current power supply ($V_{dc}$) and said first electrode terminal ($T_D$), and a transistor ($T_{r1}$), output terminal thereof being connected to said first electrode terminal ($T_D$) and input terminal thereof being connected to said second electrode terminal ($T_F$), said vibrating assembly acting as a resonance element and said transistor ($T_{r1}$) acting as a feedback amplifier element, said means for dispensing a liquid to said plurality of holes comprising a supporting material upholding said piezoelectric vibrator and having a lower acoustic impedance compared with that of said piezoelectric vibrator, a sponge-like liquid-keeping material having a lower acoustic impedance compared with that of said piezoelectric vibrator, and a large absorption ability for dispensing a liquid to said inlet opening portion of said plurality of holes, said inlet opening portion being in contact with said sponge-like liquid-keeping material, and a liquid bath for accommodating said sponge-like liquid-keeping material and supplying said sponge-like liquid-keeping material with a liquid, said piezoelectric vibrator having a rectangular plate-shaped body, the ratio of length to width thereof being substantially equal to 1, said first electrode (D) having about three to four times as large an area on said one end surface of said piezoelectric vibrator as said second electrode (F), a linear area between said first and second electrodes (D and F) on said one end surface of said piezoelectric vibrator being located parallel to the length direction of said piezoelectric vibrator, and said vibrating plate being mounted on an edge of said electrode (G) in parallel to the width direction of said piezoelectric vibrator.

4. An ultrasonic atomizing device comprising:

a piezoelectric vibrator having two end surfaces running perpendicular to the thickness direction of said piezoelectric vibrator;

at least first and second electrodes (D and F), formed on one end surface of said piezoelectric vibrator with electrically separated condition each other;

at least one electrode (G) formed on the other end surface of said piezoelectric vibrator;

first and second electrode terminals ($T_D$ and $T_F$) formed on said first and second electrodes (D and F), respectively;

an electrode terminal ($T_G$) formed on said electrode (G);

a vibrating plate having a plurality of holes and connected to said electrode (G);

a self-oscillator circuit; and means for dispensing a liquid to said plurality of holes, said piezoelectric vibrator, said vibrating plate, said first and second electrodes (D and F) and said electrode (G) forming a vibrating assembly, said first electrode terminal ($T_D$) and said electrode terminal ($T_G$) receiving an electric signal with a frequency approximately equal to a resonance frequency of said vibrating assembly and causing said piezoelectric vibrator to vibrate acoustically, said piezoelectric vibrator causing said vibrating plate to vibrate acoustically and generating an electric signal between said second electrode terminal ($T_F$) and said electrode terminal ($T_G$), said second electrode terminal ($T_F$) and said electrode terminal ($T_G$) delivering said electric signal, generated between said second electrode terminal ($T_F$) and said electrode terminal ($T_G$) and having a frequency approximately equal to said resonance frequency of said vibrating assembly, said vibrating plate atomizing a liquid dispensed to said plurality of holes by the acoustic vibration of said vibrating plate, each of said plurality of holes having an inlet opening portion and an outlet opening portion, the liquid penetrating from said inlet opening portion to said outlet opening portion during atomizing the liquid, the circumference of said inlet opening portion being larger than that of said outlet opening portion, said self-oscillator circuit comprising a direct current power supply ($V_{dc}$), a current pick up circuit comprising a first diode ($D_1$) connected in series to said second electrode terminal ($T_F$) and said electrode terminal ($T_G$), and a second diode ($D_2$) connected in parallel to said first diode ($D_1$) with the opposite polarity to said first diode ($D_1$), said current pick up circuit picking up a phase of a current between said second electrode terminal ($T_F$) and said electrode terminal ($T_G$), a voltage amplifying circuit including an inverter ($IC_1$) and amplifying a weak voltage picked up by said current pick up circuit, and a power amplification circuit including a transistor ($T_{r1}$) and a coil ($L_1$) for raising a voltage in a passage for applying said transistor ($T_{r1}$) with a direct current, an output power of said power amplification circuit being applied through said first electrode terminal ($T_D$) and said electrode terminal ($T_G$), said vibrating assembly acting as a resonance element and said transistor ($T_{r1}$) acting as a feedback amplifier element, said means for dispensing a liquid to said plurality of holes comprising a supporting material upholding said piezoelectric vibrator and having a lower acoustic impedance compared with that of said piezoelectric vibrator, a sponge-like liquid-keeping material having a lower acoustic impedance compared with that of said piezoelectric vibrator, and a large absorption ability for dispensing a liquid to said inlet opening portion of said plurality of holes, said inlet opening portion being in contact with said sponge-like liquid-keeping material, and a liquid bath for accommodating said sponge-like liquid-keeping material and supplying said sponge-like liquid-keeping material with a liquid, said piezoelectric vibrator having a pillar-shaped body with a pierced hole located parallel to the thickness direction of said piezoelectric vibrator, the ratio of length in the thickness direction of said piezoelectric vibrator to the shortest distance between the outer edge and the inner edge of an end surface of said piezoelectric vibrator being approximately equal to 1, said first electrode (D) having approximately the same area on said one end surface of said piezoelectric vibrator as said second electrode (F), or the area not only more than the same as said second electrode (F) but also less than five times said second electrode (F), and said vibrating plate covering an opening of said pierced hole.

* * * * *